US009362646B2

(12) United States Patent
Cohen

(10) Patent No.: US 9,362,646 B2
(45) Date of Patent: Jun. 7, 2016

(54) MATING INTERFACES FOR HIGH SPEED HIGH DENSITY ELECTRICAL CONNECTOR

(71) Applicant: Thomas S. Cohen, New Boston, NH (US)

(72) Inventor: Thomas S. Cohen, New Boston, NH (US)

(73) Assignee: Amphenol Corporation, Wallingford Center, CT (US)

( * ) Notice: Subject to any disclaimer, the term of this patent is extended or adjusted under 35 U.S.C. 154(b) by 0 days.

(21) Appl. No.: 14/209,795

(22) Filed: Mar. 13, 2014

(65) Prior Publication Data

US 2014/0273671 A1 Sep. 18, 2014
US 2015/0118922 A9 Apr. 30, 2015

Related U.S. Application Data

(60) Provisional application No. 61/800,900, filed on Mar. 15, 2013.

(51) Int. Cl.

| | |
|---|---|
| ***H01R 13/05*** | (2006.01) |
| ***H01R 13/02*** | (2006.01) |
| ***H01R 43/26*** | (2006.01) |
| ***H01R 13/11*** | (2006.01) |
| ***H01R 43/16*** | (2006.01) |
| *H01R 12/73* | (2011.01) |

(52) U.S. Cl.

CPC ..... *H01R 13/05* (2013.01); *H01R 13/02* (2013.01); *H01R 13/113* (2013.01); *H01R 43/16* (2013.01); *H01R 43/26* (2013.01); *H01R 12/737* (2013.01); *Y10T 29/49117* (2015.01); *Y10T 29/49208* (2015.01)

(58) Field of Classification Search

USPC ..... 439/891, 839, 856, 857, 842, 825
See application file for complete search history.

(56) References Cited

U.S. PATENT DOCUMENTS

| | | | | | |
|---|---|---|---|---|---|
| 3,516,043 | A | * | 6/1970 | Spofford | 439/287 |
| 3,757,284 | A | * | 9/1973 | Klehm, Jr. | 439/842 |
| 3,787,801 | A | * | 1/1974 | Teagno et al. | 439/855 |
| 4,553,799 | A | * | 11/1985 | Deters | 439/507 |
| 4,632,476 | A | | 12/1986 | Schell | |
| 4,806,107 | A | | 2/1989 | Arnold et al. | |
| 4,846,727 | A | | 7/1989 | Glover et al. | |
| 4,975,084 | A | | 12/1990 | Fedder et al. | |
| 5,007,865 | A | * | 4/1991 | Jakobeit | 439/839 |

(Continued)

FOREIGN PATENT DOCUMENTS

JP 2006-344604 A 12/2006

OTHER PUBLICATIONS

International Search Report and Written Opinion for PCT/US2014/028998 mailed Aug. 8, 2014.

*Primary Examiner* — Alexander Gilman
(74) *Attorney, Agent, or Firm* — Wolf, Greenfield & Sacks, P.C.

(57) ABSTRACT

Mating interfaces for high speed, high density electrical connectors. In some embodiments, a contact comprises a base region, a first elongated member comprising a distal end attached to the base region and a proximal portion, a second elongated member comprising a distal end attached to the base region and a proximal portion, and a strap coupling the distal portion of the first elongated member to the distal portion of the second elongated member, wherein the strap is conductive and compliant such that the distal portion of the first elongated member is capable of moving independently of and is electrically connected to the distal portion of the second elongated member.

20 Claims, 34 Drawing Sheets

(56) References Cited

U.S. PATENT DOCUMENTS

| | | | | |
|---|---|---|---|---|
| 5,066,236 | A | 11/1991 | Broeksteeg | |
| 5,108,304 | A * | 4/1992 | Bogiel et al. | 439/290 |
| 5,429,520 | A | 7/1995 | Morlion et al. | |
| 5,429,521 | A | 7/1995 | Morlion et al. | |
| 5,433,617 | A | 7/1995 | Morlion et al. | |
| 5,433,618 | A | 7/1995 | Morlion et al. | |
| 5,484,310 | A | 1/1996 | McNamara et al. | |
| 5,496,183 | A | 3/1996 | Soes et al. | |
| 6,116,926 | A * | 9/2000 | Ortega et al. | 439/108 |
| 6,293,827 | B1 | 9/2001 | Stokoe | |
| 6,299,438 | B1 | 10/2001 | Sahagian et al. | |
| 6,383,039 | B1 * | 5/2002 | Yoneyama et al. | 439/856 |
| 6,478,599 | B1 * | 11/2002 | McHugh et al. | 439/342 |
| 6,478,637 | B1 * | 11/2002 | Ohkita et al. | 439/857 |
| 6,503,103 | B1 | 1/2003 | Cohen et al. | |
| 6,776,659 | B1 | 8/2004 | Stokoe et al. | |
| 6,805,591 | B2 * | 10/2004 | Garland et al. | 439/733.1 |
| 7,163,421 | B1 | 1/2007 | Cohen et al. | |
| 7,595,715 | B2 * | 9/2009 | Pavlovic et al. | 337/198 |
| 7,789,708 | B2 * | 9/2010 | Laurx et al. | 439/108 |
| 7,794,278 | B2 * | 9/2010 | Cohen et al. | 439/607.09 |
| 8,057,266 | B1 * | 11/2011 | Roitberg | 439/682 |
| 8,096,843 | B2 * | 1/2012 | Gong | 439/856 |
| 8,298,015 | B2 * | 10/2012 | Cohen et al. | 439/607.1 |
| 8,317,551 | B2 * | 11/2012 | Aboulkassem et al. | 439/825 |
| 2001/0010979 | A1 | 8/2001 | Ortega et al. | |
| 2002/0025732 | A1 * | 2/2002 | Hsieh | 439/845 |
| 2004/0018757 | A1 | 1/2004 | Lang et al. | |
| 2009/0264023 | A1 * | 10/2009 | Yi et al. | 439/709 |
| 2010/0323109 | A1 | 12/2010 | Hamilton et al. | |

* cited by examiner

MATING INTERFACES FOR HIGH SPEED HIGH DENSITY ELECTRICAL CONNECTOR

RELATED APPLICATION

The present application claims the benefit of U.S. Provisional Application Ser. No. 61/80,000, filed Mar. 15, 2013, which is hereby incorporated by reference herein in its entirety.

BACKGROUND

This invention relates generally to electrical connectors used to interconnect printed circuit boards and more specifically to improved mating interfaces for such connectors.

Electrical connectors are used in many electronic systems. It is generally easier and more cost effective to manufacture a system on several printed circuit boards ("PCBs") which may be joined together with electrical connectors. A traditional arrangement for joining several printed circuit boards is to have one printed circuit board serve as a backplane. Other printed circuit boards, called "daughter boards" or "daughter cards," may be connected through the backplane.

A traditional backplane is a printed circuit board onto which many connectors may be mounted. Conducting traces in the backplane may be electrically connected to signal conductors in the connectors so that signals may be routed between the connectors. Daughter cards may also have connectors mounted thereon. The connectors mounted on a daughter card may be plugged into the connectors mounted on the backplane. In this way, signals may be routed among the daughter cards through the backplane. The daughter cards may plug into the backplane at a right angle. The connectors used for these applications may therefore include a right angle bend and are often called "right angle connectors."

Connectors may also be used in other configurations for interconnecting printed circuit boards and for interconnecting other types of devices such as cables to printed circuit boards. Sometimes, one or more smaller printed circuit boards may be connected to another larger printed circuit board. In such a configuration, the larger printed circuit board may be called a "mother board" and the printed circuit boards connected to it may be called daughter boards. Also, boards of the same size or similar sizes may sometimes be aligned in parallel. Connectors used in these applications are often called "stacking connectors" or "mezzanine connectors."

Regardless of the exact application, electrical connector designs have been adapted to minor trends in the electronics industry. Electronic systems generally have gotten smaller, faster, and functionally more complex. Because of these changes, the number of circuits in a given area of an electronic system, along with the frequencies at which the circuits operate, have increased significantly in recent years. Current systems pass more data between printed circuit boards and require electrical connectors that are electrically capable of handling more data at higher speeds than connectors of even a few years ago.

In a high density, high speed connector, electrical conductors may be so close to each other that there may be electrical interference between adjacent signal conductors. To reduce interference, and to otherwise provide desirable electrical properties, shield members are often placed between or around adjacent signal conductors. The shields may prevent signals carried on one conductor from creating "crosstalk" on another conductor. The shield may also impact the impedance of each conductor, which may further contribute to desirable electrical properties.

Examples of shielding can be found in U.S. Pat. Nos. 4,632,476 and 4,806,107, which show connector designs in which shields are used between columns of signal contacts. These patents describe connectors in which the shields run parallel to the signal contacts through both the daughter board connector and the backplane connector. Cantilevered beams are used to make electrical contact between the shield and the backplane connectors. U.S. Pat. Nos. 5,433,617, 5,429,521, 5,429,520, and 5,433,618 show a similar arrangement, although the electrical connection between the backplane and shield is made with a spring type contact. Shields with torsional beam contacts are used in the connectors described in U.S. Pat. No. 6,299,438.

Other connectors have the shield plate within only the daughter board connector. Examples of such connector designs can be found in U.S. Pat. Nos. 4,846,727, 4,975,084, 5,496,183, and 5,066,236. Another connector with shields only within the daughter board connector is shown in U.S. Pat. No. 5,484,310.

Another modification made to connectors to accommodate changing requirements is that connectors have become much larger in some applications. Increasing the size of a connector may lead to manufacturing tolerances that are much tighter. For instance, the permissible mismatch between the conductors in one half of a connector and the receptacles in the other half may be constant, regardless of the size of the connector. However, this constant mismatch, or tolerance, may become a decreasing percentage of the connector's overall length as the connector gets larger. Therefore, manufacturing tolerances may be tighter for larger connectors, which may increase manufacturing costs. One way to avoid this problem is to use modular connectors. Teradyne Connection Systems of Nashua, N.H., USA pioneered a modular connector system called HD+®. This system has multiple modules, each having multiple columns of signal contacts, such as 15 or 20 columns. The modules are held together on a metal stiffener.

Another modular connector system is shown in U.S. Pat. Nos. 5,066,236 and 5,496,183. Those patents describe "module terminals" each having a single column of signal contacts. The module terminals are held in place in a plastic housing module. The plastic housing modules are held together with a one-piece metal shield member. Shields may be placed between the module terminals as well.

Other techniques may be used to control the performance of a connector. For instance, transmitting signals differentially may also reduce crosstalk. Differential signals are carried on a pair of conducting paths, called a "differential pair." The voltage difference between the conductive paths represents the signal. In general, a differential pair is designed with preferential coupling between the conducting paths of the pair. For example, the two conducting paths of a differential pair may be arranged to run closer to each other than to adjacent signal paths in the connector. No shielding is desired between the conducting paths of the pair, but shielding may be used between differential pairs. Electrical connectors can be designed for differential signals as well as for single-ended signals. Examples of differential electrical connectors are shown in U.S. Pat. Nos. 6,293,827, 6,503,103, 6,776,659, 7,163,421, and 7,794,278.

SUMMARY

In accordance with some embodiments, a contact for a high speed electrical connector is provided, the contact comprising: a base region; a first elongated member comprising a distal end attached to the base region and a proximal portion; a second elongated member comprising a distal end attached to the base region and a proximal portion; and a strap coupling the distal portion of the first elongated member to the distal portion of the second elongated member, wherein the strap is conductive and compliant such that the distal portion of the first elongated member is capable of moving independently of and is electrically connected to the distal portion of the second elongated member.

In accordance with some embodiments, an electrical connector is provided, comprising: a plurality of conductive members, each conductive member comprising a contact tail, a contact portion, and an intermediate portion joining the contact tail to the contact portion, wherein: the mating contact portions are arranged in a plurality of parallel columns; for each of the plurality of conductive members, the mating contact portion comprises a blade connected to the intermediate portion and a beam connected to the intermediate portion and a conductive, compliant member linking the blade to the beam.

In accordance with some embodiments, a method of operating an electrical connector to mate with a mating electrical connector, the method comprising: for each of a plurality of conductive members in the connector, the conductive members each comprising a contact with a first elongated member and a second elongated member joined by a conductive strap: sliding the first elongated member with respect to a first mating contact member in the mating connector into a mating position with a first point of contact between the first elongated member and the first mating contact member; sliding the second elongated member with respect to a second mating contact member in the mating connector into a mating position with a second point of contact between the second elongated member and the second mating contact member, wherein the strap connects to the second elongated member at a location distal to the second point of contact.

DESCRIPTION OF THE PREFERRED EMBODIMENT

The inventors have recognized and appreciated designs of mating contact portions of an electrical connector that improve signal integrity for high frequency signals, such as at frequencies in the GHz range, including up to about 25 GHz or up to about 40 GHz or higher, while maintaining high density, such as with a spacing between adjacent mating contacts on the order of 2 mm or less, including center-to-center spacing between adjacent contacts in a column of between 0.75 mm and 1.8 mm or between 1 mm and 1.75 mm, for example. Spacing between columns of mating contact portions may be similar, although there is no requirement that the spacing between all mating contacts in a connector be the same.

The present disclosure is not limited to the details of construction or the arrangements of components set forth in the following description and/or the drawings. Various embodiments are provided solely for purposes of illustration, and the concepts described herein are capable of being practiced or carried out in other ways. Also, the phraseology and terminology used herein are for the purpose of description and should not be regarded as limiting. The use of "including," "comprising," "having," "containing," or "involving," and variations thereof herein, is meant to encompass the items listed thereafter (or equivalents thereof) and/or as additional items.

Figure 1A:
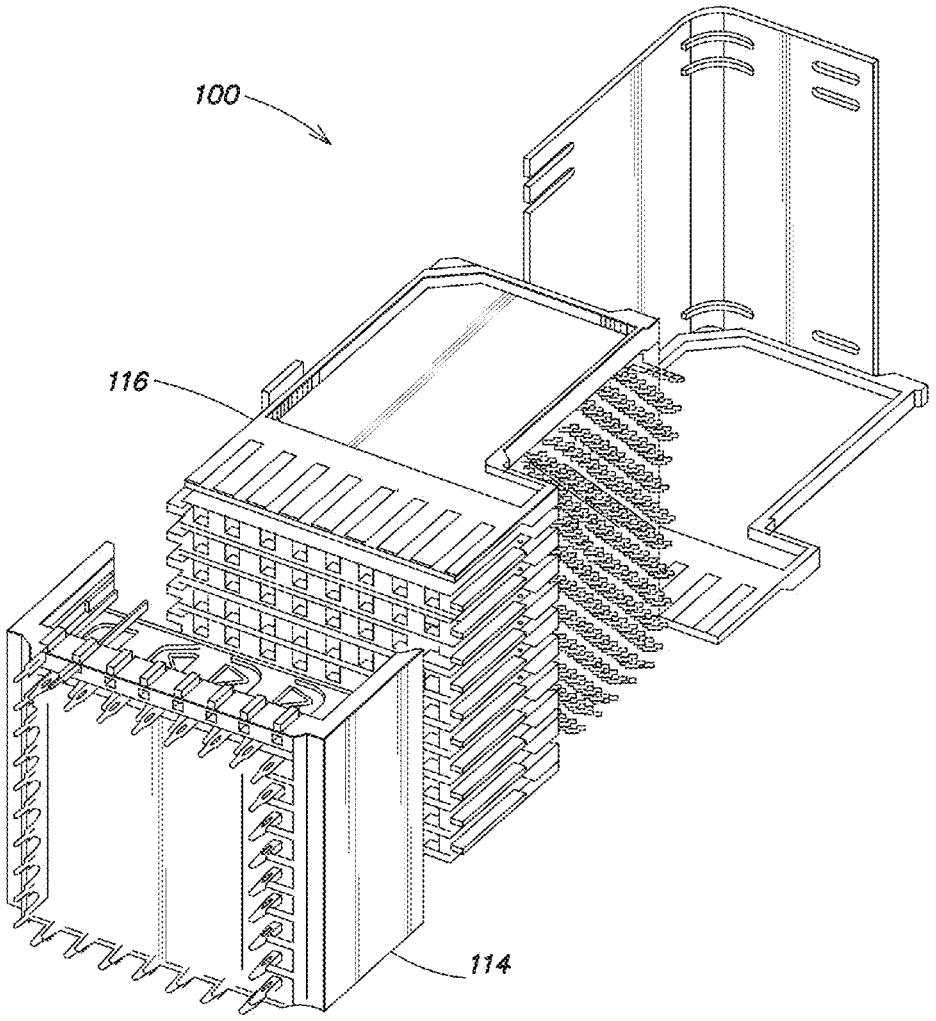
FIG. 1A is an isometric view of an illustrative electrical interconnection system, in accordance with some embodiments.

FIG. 1A is an isometric view of an illustrative electrical interconnection system 100, in accordance with some embodiments. In this example, the electrical interconnection system 100 includes a backplane connector 114 and a daughter card connector 116 adapted to mate with each other.

Figure 1B:
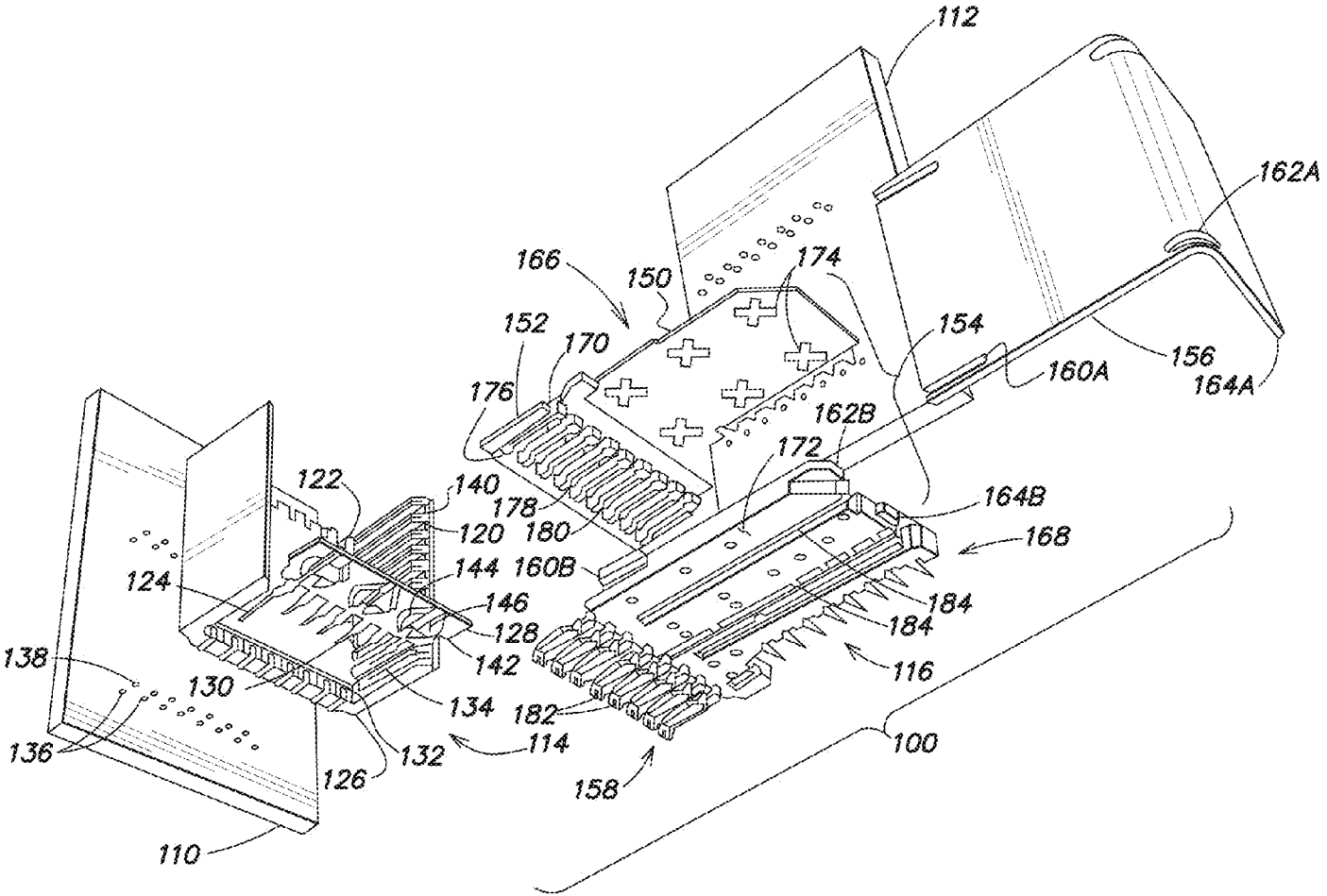
FIG. 1B is an exploded view of the illustrative electrical interconnection system shown in FIG. 1A, in accordance with some embodiments.

FIG. 1B shows an exploded view of the illustrative electrical interconnection system 100 shown in FIG. 1B, in accordance with some embodiments. As shown in FIG. 1A, the backplane connector 114 may be adapted to plug into a backplane 110, and the daughter card connector 116 may be adapted to plug into a daughter card 112. When the backplane connector 114 and the daughter card connector 116 mate with each other, conductors in these two connectors become electrically connected, thereby completing conductive paths between corresponding conductive elements in the backplane 110 and the daughter card 112.

Although not shown, the backplane 110 may, in some embodiments, have many other backplane connectors attached to it so that multiple daughter cards can be connected to the backplane 110. Additionally, multiple backplane connectors may be aligned end to end so that they may be used to connect to one daughter card. However, for clarity, only a portion of the backplane 110 and a single daughter card 112 are shown in FIG. 1B.

In the example of FIG. 1B, the backplane connector 114 may include a shroud 120, which may serve as a base for the backplane connector 114. In various embodiments, the shroud 120 may be molded from a dielectric material such as plastic or nylon. Examples of suitable materials include, but are not limited to, liquid crystal polymer (LCP), polyphenyline sulfide (PPS), high temperature nylon or polypropylene (PPO). Other suitable materials may be employed, as aspects of the present disclosure are not limited in this regard.

All of the above-described materials are suitable for use as binder material in manufacturing connectors. In accordance some embodiments, one or more fillers may be included in some or all of the binder material used to form the backplane shroud 120 to control the electrical and/or mechanical properties of the backplane shroud 120. As a non-limiting example, thermoplastic PPS filled to 30% by volume with glass fiber may be used.

In some embodiments, the floor of the shroud 120 may have columns of openings 126, and conductors 122 may be inserted into the openings 126 with tails 124 extending through the lower surface of the shroud 120. The tails 124 may be adapted to be attached to the backplane 110. For example, in some embodiments, the tails 124 may be adapted to be inserted into respective signal holes 136 on the backplane 110. The signal holes 136 may be plated with some suitable conductive material and may serve to electrically connect the conductors 122 to signal traces (not shown) in the backplane 110.

In some embodiments, the tails 124 may be press fit "eye of the needle" compliant sections that fit within the signal holes 136. However, other configurations may also be used, such as surface mount elements, spring contacts, solderable pins, etc., as aspects of the present disclosure are not limited to the use of any particular mechanism for attaching the backplane connector 114 to the backplane 110.

For clarity of illustration, only one of the conductors 122 is shown in FIG. 1B. However, in various embodiments, the backplane connector may include any suitable number of parallel columns of conductors and each column may include any suitable number of conductors. For example, in one embodiment, there are eight conductors in each column.

The spacing between adjacent columns of conductors is not critical. However, a higher density may be achieved by placing the conductors closes together. As a non-limiting example, the conductors 122 may be stamped from 0.4 mm thick copper alloy, and the conductors within each column may be spaced apart by 2.25 mm and the columns of conductors may be spaced apart by 2 mm. However, in other embodiments, smaller dimensions may be used to provide higher density.

In the example shown in FIG. 1B, a groove 132 is formed in the floor of the shroud 120. The groove 132 runs parallel to the column of openings 126. The shroud 120 also has grooves 134 formed in its inner sidewalls. In some embodiments, a shield plate 128 is adapted fit into the grooves 132 and 134. The shield plate 128 may have tails 130 adapted to extend through openings (not visible) in the bottom of the groove 132 and to engage ground holes 138 in the backplane 110. Like the signal holes 136, the ground holes 138 may be plated with any suitable conductive material, but the ground holes 138 may connect to ground traces (not shown) on the backplane 110, as opposed to signal traces.

In the example shown in FIG. 1B, the shield plate 128 has seven tails 130, with each tail falling between two adjacent conductors 122. It may be desirable for a tail of the shield plate 128 to be as close as possible to a corresponding one of the conductors 122. However, centering a tail between two adjacent signal conductors may allow the spacing between the shield plate 128 and a column of signal conductors 122 to be reduced.

In the example shown in FIG. 1B, the shield plate 128 has several torsional beam contacts 142 formed therein. In some embodiments, each contact may be formed by stamping arms 144 and 146 in the shield plate 128. Arms 144 and 146 may then be bent out of the plane of the shield plate 128, and may be long enough that they may flex when pressed back into the plane of the shield plate 128. Additionally, the arms 144 and 146 may be sufficiently resilient to provide a spring force when pressed back into the plane of the shield plate 128. The spring force generated by each arm 144 or 146 may create a point of contact between the arm and a shield plate 150 of the daughter card connector 116 when the backplane connector 114 is mated with the daughter card connector 116. The generated spring force may be sufficient to ensure this contact even after the daughter card connector 116 has been repeatedly mated and unmated from the backplane connector 114.

In some embodiments, the arms 144 and 146 may be coined during manufacture. Coining may reduce the thickness of the material and increase the compliancy of the beams without weakening the shield plate 128. For enhanced electrical performance, it may also be desirable that the arms 144 and 146 be short and straight. Therefore, in some embodiments, the arms 114 and 146 are made only as long as needed to provide sufficient spring force.

In addition, for electrical performance, it may be desirable to have at least one arm of the shield plate 128 close to each one of the signal conductors 122. For example, in some embodiments, there may be one pair of arms 144 and 146 for each of the signal conductors 122. For the example, if there are eight signal conductors 122 in each column, there may be eight arms, forming four balanced torsional beam contacts 142 (i.e., a pair of arms 144 and 146 forming one torsional beam contact). However, other configurations are also possible. For instance, in the example shown in FIG. 1B, there are only three balanced torsional beam contacts 142 for each column of conductors. This configuration may represent a compromise between desired electrical properties and a desired amount of spring force generated by each torsional beam contact.

In the example shown in FIG. 1B, grooves 140 are formed on the inner sidewalls of the shroud 120. These grooves may be used to align the daughter card connector 116 with the backplane connector 114 during mating. For example, in some embodiments, tabs 152 of the daughter card connector 116 may be adapted to fit into corresponding grooves 140 for alignment and/or to prevent side-to-side motion of the daughter card connector 116 relative to the backplane connector 114.

In some embodiments, the daughter card connector 116 may include one or more wafers. In the example of FIG. 1B, only one wafer 154 is shown for clarity, but the daughter card connector 116 may have several wafers stacked side to side. In some embodiments, the wafer 154 may include a column of one or more receptacles 158, where each receptacle 158 may be adapted to engage a respective one of the conductors 122 of the backplane connector 114 when the backplane connector 114 and the daughter card connector 116 are mated. Thus, in such an embodiment, the daughter card connector 116 may have as many wafers as there are columns of conductors in the backplane connector 114.

In the example shown in FIG. 1B, wafers of the daughter card connector 116 are supported in a stiffener 156. In some embodiments, the stiffener 156 may be stamped and formed from a metal strip. However, it should be appreciated that other materials and/or manufacturing techniques may also be suitable, as aspects of the present disclosure are not limited to the use of any particular type of stiffeners, or any stiffener at all. Furthermore, other structures, including a housing portion to which individual wafers may be attached may alternatively or additionally be used to support the wafers. In some embodiments, if the housing portion is insulative, it may have cavities that receive mating contact portions of the wafers to electrically isolate the mating contact portions. Alternatively or additionally, a housing portion may incorporate materials that impact electrical properties of the connector. For example, the housing may include shielding and/or electrically lossy material.

In embodiments with a stiffener, the stiffener 156 may be stamped with features (e.g., one or more attachment points) to hold the wafer 154 in a desired position. As a non-limiting example, the stiffener 156 may have a slot 160A formed along its front edge. The slot 160A may be adapted to engage a tab 160B of the wafer 154. The stiffener 156 may further include holes 162A and 164A, which may be adapted to engage, respectively, hubs 162B and 164B of the wafer 154. In some embodiments, the hubs 162B and 164B are sized to provide an interference fit in the holes 162A and 164A, respectively. However, it should be appreciated that other types of attachment mechanism may also be suitable, such as by using adhesives.

While specific combination and arrangement of slots and holes on the stiffener 156 are shown in FIG. 1B, it should be appreciated that aspects of the present disclosure are not limited to any particular way of attaching wafers to the stiffener 156. For example, the stiffener 156 may have a set of slots and/or holes for each wafer supported by the stiffener 156, so that a pattern of slots and/or holes is repeated along the length of stiffener 156 at each point where a wafer is to be attached. Alternatively, the stiffener 156 may have different combinations of slots and/or holes, or may have different attachment mechanisms for different wafers.

In the example shown in FIG. 1B, the wafer 154 includes two pieces, a shield piece 166 and a signal piece 168. In some embodiments, the shield piece 166 may be formed by insert molding a housing 170 around a front portion of the shield plate 150, and the signal piece 168 may be formed by insert molding a housing 172 around one or more conductive elements. Examples of such conductive elements are described in greater detail below in connection with FIG. 5A.

In some embodiments, the signal piece 168 and the shield piece 166 may have features that hold them together. For example, the signal piece 168 may have hubs (not visible) formed on one surface. The hubs may be positioned and adapted to engage clips 174 formed in the shield plate 150 when the shield piece 166 and the signal piece 168 are assembled into the wafer 154. An interference fit between the clips 174 and the corresponding hubs may hold the shield plate 150 firmly against the signal piece 168. However, it should be appreciated that other attachment mechanisms may be used to hold the signal piece 168 and the shield piece 166 together. Furthermore, in alternative embodiments, there may be no attachment mechanism, and the signal piece 168 and the shield piece 166 may simply be disposed next to each other in the daughter card connector 116. Furthermore, it should be appreciated that in some embodiments, a wafer may be manufactured without any shield plate and may include attachment features such that a shield plate may be attached. Further still, it should be appreciated that a shield plate, though pictured as stamped from a sheet of metal, need not be continuous or planar. In some embodiments, the shield plate may have one or more openings and may have any suitable contour, for example, to position shielding material between conductive elements that may be susceptible to crosstalk.

In the example shown in FIG. 1B, the housing 170 has cavities 176 formed in it, where each cavity is shaped to receive a respective one of the receptacles 158. In some embodiments, a cavity may have a platform 178 at its bottom, and the platform 178 may have an opening 180 formed through it. The opening 180 may be adapted to receive a corresponding one of the conductors 122 of the daughter card connector 116 when the daughter card connector 116 mates with the backplane connector 114. Thus, when a corresponding one of the receptacles 158 is received in the cavity and a corresponding one of the conductors 122 is received in the opening 180, the receptacle makes electrical contact with the conductor, thereby providing a signal path through the electrical interconnection system 100.

In some embodiments, a receptacle may be formed with two legs, such as legs 182 in the example of FIG. 1B. The legs 182 may be adapted to fit on opposite sides of the platform 178 when the receptacle is inserted into the corresponding one of the cavities 176. In some embodiments, the receptacle may be formed such that the spacing between the two legs 182 is smaller than the width of platform 178. Thus, to insert the receptacle into the corresponding one of the cavities 176, a tool may be used to spread the legs 182.

A receptacle formed in this manner is sometimes called a "preloaded" contact. Because the legs 182 are spread by the platform 178, such a contact has a lower insertion force and is less likely to stub on the corresponding conductor of the daughter card connector 116 when the daughter card connector 116 mates with the backplane connector 114.

In the example shown in FIG. 1B, the housing 172 has grooves 184 formed in it. As described above, in some embodiments, hubs formed on one side of the signal piece 168 project through the shield plate 150. The grooves 184 on the housing 172 may be positioned and adapted to receive similar hubs of the signal piece of another wafer disposed adjacent to the wafer 154. Such hubs and the grooves 184 may help hold adjacent wafers together and prevent the rotation of one wafer with respect to an adjacent wafer. These features, in conjunction with the stiffener 156, may be used in some embodiments to replace a separate box or housing that holds the wafers together, thereby simplifying the electrical interconnection system 100. However, it should be appreciated that aspects of the present disclosure are not limited to the use of any particular fastening features.

In the example shown in FIG. 1B, the housings 170 and 172 are shown with numerous holes (not numbered) in them. These are "pinch holes" used to hold the shield plate 150 or conductive elements during injection molding. Aspects of the present disclosure are not limited to the presence or any particular arrangement of such pinch holes.

Figure 2B:
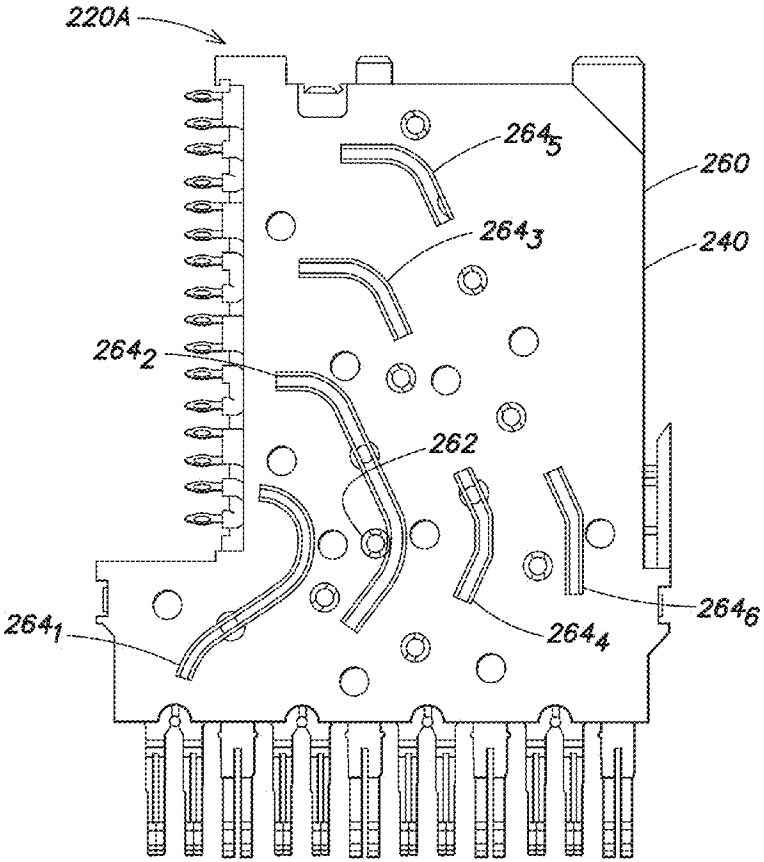
FIGS. 2A-B show opposing side views of an illustrative wafer, in accordance with some embodiments.
Figure 2A:
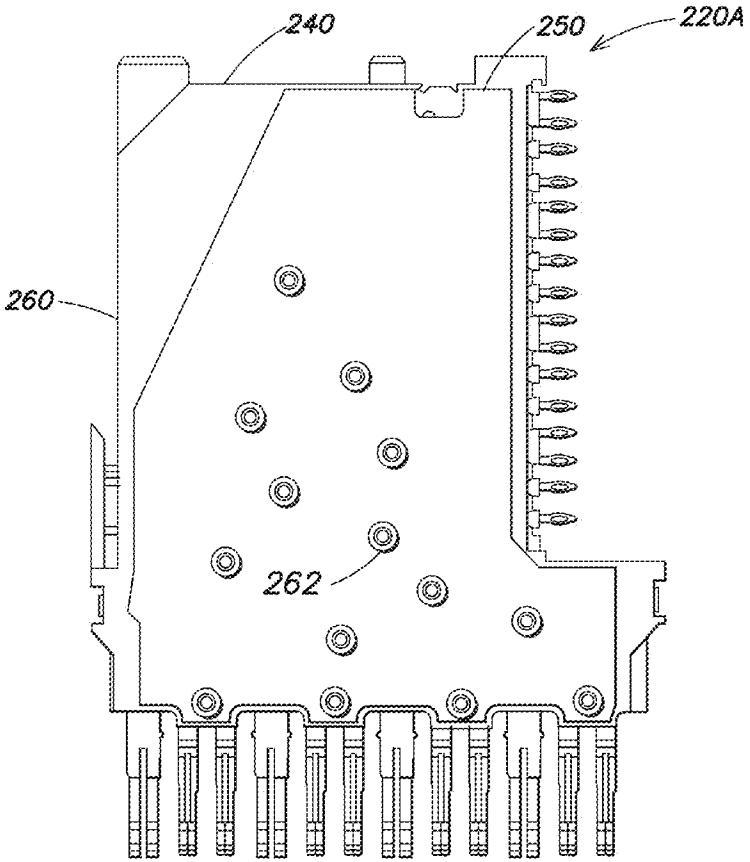

FIGS. 2A-B show opposing side views of an illustrative wafer 220A, in accordance with some embodiments. The wafer 220A may be formed in whole or in part by injection molding of material to form a housing 260 around a wafer strip assembly. Examples of wafer strip assemblies are described in greater detail below in connection with FIGS. 4A-B. In the example shown in FIGS. 2A-B, the wafer 220A is formed with a two shot molding operation, allowing the housing 260 to be formed of two types of materials having different properties. The insulative portion 240 is formed in a first shot and a lossy portion 250 is formed in a second shot.

However, any suitable number and types of materials may be used in the housing 260. For example, in some embodiments, the housing 260 is formed around a column of conductive elements by injection molding plastic.

In some embodiments, the housing 260 may be provided with openings, such as windows or slots $\mathbf{264}_1 \ldots \mathbf{264}_6$, and holes, of which hole 262 is numbered, adjacent signal conductors enclosed in the housing 260. These openings may serve multiple purposes, including: (i) to ensure during an injection molding process that the conductive elements are properly positioned, and/or (ii) to facilitate insertion of materials that have different electrical properties, if so desired.

In some embodiments, regions of different dielectric constants may be selectively located adjacent signal conductors of a wafer to obtain desired performance characteristics. (The dielectric constant of a material is sometimes also referred to as the "relative permittivity" of the material.)

In the example shown in FIGS. 2A-B, the slots $\mathbf{264}_1 \ldots \mathbf{264}_6$ in the housing 260 may position air adjacent selected signal conductors enclosed in the housing 260. The ability to place air, or other material that has a dielectric constant lower than the dielectric constant of material used to form other portions of the housing 260, in close proximity to a signal conductor in a differential pair provides a way to "de-skew" the differential pair of signal conductors, as discussed below.

The time it takes an electrical signal to propagate from one end of a signal conductor to the other end is known as the "propagation delay." In some embodiments, it may be desirable that the signals within a pair have the same propagation delay, which is commonly referred to as having "zero skew" within the pair. The propagation delay within a conductor may be influenced by the dielectric constant of material near the conductor, where a lower dielectric constant may lead to a lower propagation delay. A vacuum has the lowest possible dielectric constant with a value of 1. Air has a similarly low dielectric constant, whereas dielectric materials have higher dielectric constants. For example, LCP has a dielectric constant of between about 2.5 and about 4.5.

In some embodiments, the signal conductors of a differential pair may have different physical lengths. This may be the case, for example, in a right-angle connector. To equalize the propagation delay in the signal conductors of a differential pair even though they have physically different lengths, the relative proportion of materials of different dielectric constants around the conductors may be adjusted. For instance, in some embodiments, more air may be positioned in close proximity to the physically longer signal conductor of the pair than to the shorter signal conductor of the pair, thereby lowering the effective dielectric constant around the longer signal conductor and decreasing its propagation delay.

However, as the dielectric constant around a signal conductor is lowered, the impedance of the signal conductor may rise. To maintain balanced impedance within the pair, the size of the signal conductor in close proximity to more air may in some embodiments be increased in thickness and/or width. This may result in two signal conductors with different physical geometries, but better matched propagation delays and impedance profiles.

Figure 3A:
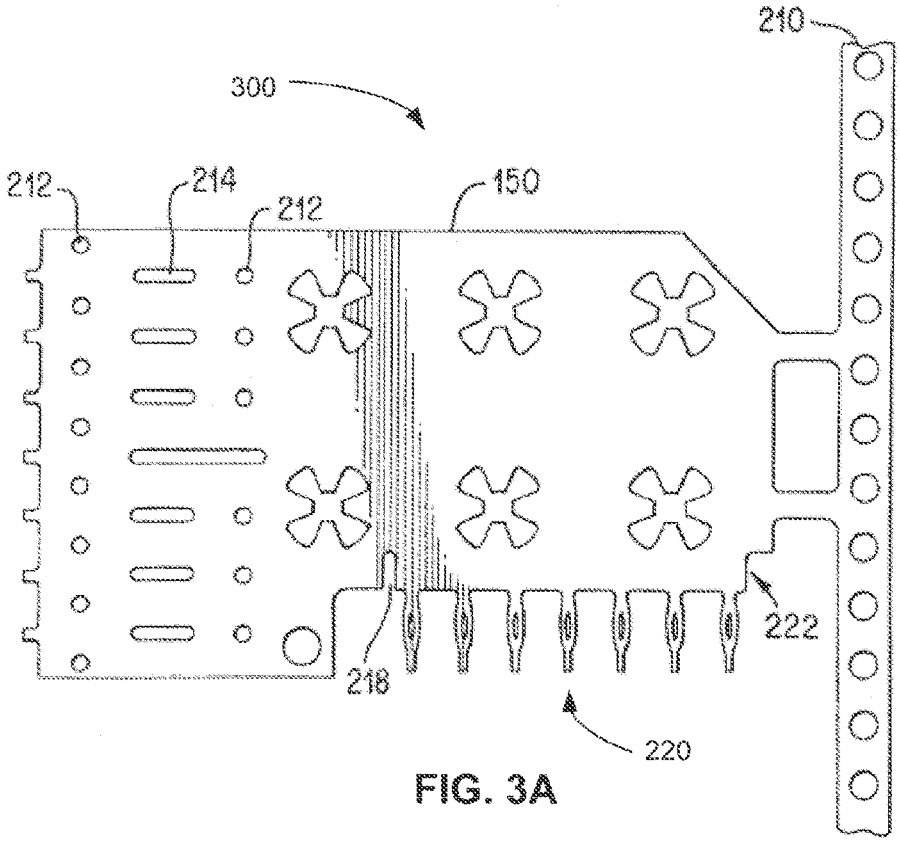
FIG. 3A shows an illustrative blank that can be used to make a shield member, in accordance with some embodiments.

FIG. 3A shows an illustrative blank 300 that can be used to make a shield member, in accordance with some embodiments. For instance, the blank 300 may be used to make the shield plate 150 in the example shown in FIG. 1. In some embodiments, the shield plate 150 may be stamped from a roll of metal, and may be retained on a carrier strip 210 for ease of handling. After the shield plate 150 is injection molded to form a shield piece (e.g., the shield piece 166 in the example shown in FIG. 1), the carrier strip 210 may be cut off.

In the example shown in FIG. 3A, the shield plate 150 includes holes 212, which may be filled with plastic when a housing (e.g., the housing 170 in the example shown in FIG. 1) is molded onto the shield plate 150, thereby locking the shield plate 150 in the housing.

In some embodiments, the shield plate 150 may also include slots 214, which may be positioned to fall between receptacles (e.g., the receptacles 158 in the example shown in FIG. 1) when the shield plate is disposed against a signal piece (e.g., the signal piece 168 in the example shown in FIG. 1). The slots 214 may be adapted to control the capacitance of the shield plate 150, which may raise or lower the overall impedance of an electrical inter connection system. The slots 214 may also channel current flow in the shield plate 150 near the receptacles of the signal piece, which form signal paths in the electrical inter connection system. Higher return current flow near the signal paths may reduce crosstalk.

In the example shown in FIG. 3A, a slot 218 may be provided in the blank 300 to allow a tail region 222 to be bent out of the plane of the shield plate 150, if desired. In some embodiments, the tail region 222 may be bent or not depending on whether the electrical interconnection system is carrying single-ended or differential signals. For example, the tail region 222 may be bent for single-ended signals, but not bent for differential signals, or vice versa.

It should be appreciated that a shield plate on a backplane connector (e.g., the shield plate 128 in the example of FIG. 1) may similarly be bent in its tail region, if desired. For example, the shield plate 128 may be bent whenever the shield plate 150 is bent, or vice versa.

In some embodiments, the tail region 222 of the shield plate 150 may be bent to match the placement of ground holes on a printed circuit board. For example, the tail region 222 may be bent to allow contact tails in the tail region (e.g., contact tail 220) to be inserted into corresponding ground holes, depending on the configuration of the ground holes. Illustrative configurations of ground holes are discussed below in connection with FIGS. 3B-C.

Figure 3B:
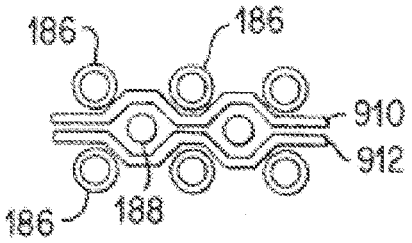
FIG. 3B shows traces on an illustrative printed circuit board routed between holes used to mount a connector, in accordance with some embodiments.

FIG. 3B shows traces 910 and 912 on an illustrative printed circuit board routed between holes used to mount a connector, in accordance with some embodiments. In some embodiments, the printed circuit board may have one or more signal holes 186 and one or more ground holes 188. When the connector is used to carry single ended signals, it may be desirable that the signal traces 910 and 912 be separated by ground to the greatest extent possible. Thus, it may be desirable that the ground holes 188 be centered between the signal holes 186 so that the signal traces 910 and 912 can be routed between the signal holes 186 and the ground holes 188, as shown in FIG. 3B.

Figure 3C:
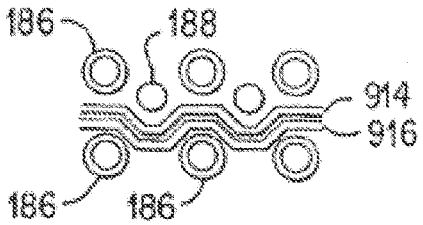
FIG. 3C shows an alternative routing of traces on an illustrative printed circuit board, in accordance with some embodiments.

FIG. 3C shows an alternative routing of traces on an illustrative printed circuit board, in accordance with some embodiments. This alternative routing pattern may be suitable for traces carrying differential signals, as it may be desirable to route such traces as close together as possible. In the example shown in FIG. 3C, to allow signal traces 914 and 916 to be close together, the ground holes 188 are not centered between the signal holes 186. Rather, the ground holes 188 are offset to be close to some of the signal holes 186. This placement allows both the signal traces 914 and 916 to be routed on the same side relative to the ground holes 188.

Figure 3D:
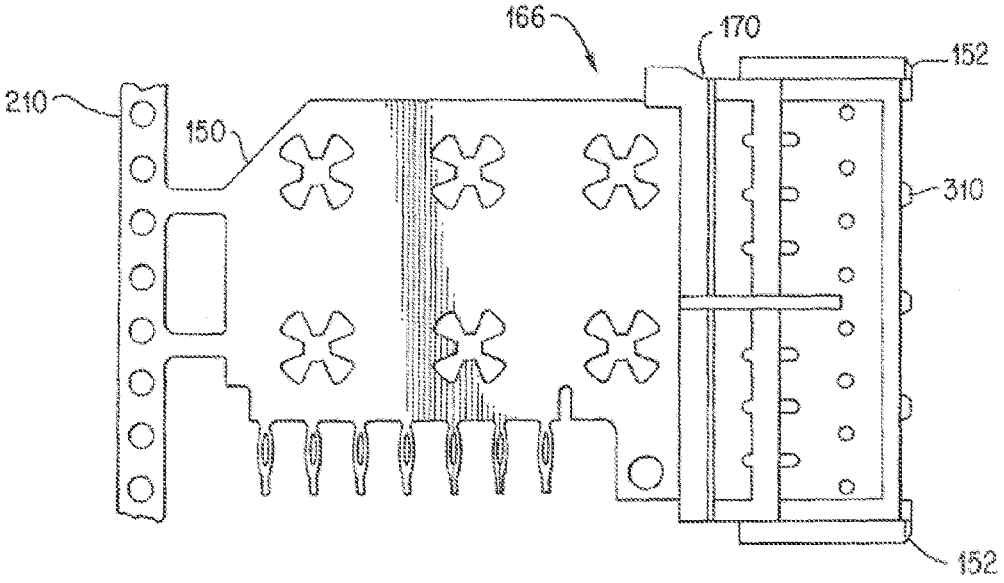
FIG. 3D shows the shield plate of FIG. 3A after it has been insert molded into a housing, in accordance with some embodiments.

FIG. 3D shows the shield plate 150 of FIG. 3A after it has been insert molded into a housing (e.g., the housing 170 in the example shown in FIG. 1B) to form a ground portion (e.g., the shield piece 166 in the example shown in FIG. 1B), in accordance with some embodiments. In the example of FIG. 3D, the housing 170 includes pyramid shaped projections 310 on a bottom face of the shield piece 166. In some embodiments, recesses (not shown) may be included in the floor of a backplane connector (e.g., the backplane connector 114 in the example of FIG. 1B) and may be adapted to receive respective ones of the projections 310. The projections 310 and the corresponding recesses may prevent the spring forces generated by the torsional beam contacts 142 from spreading adjacent wafers when the daughter card connector 116 is inserted into the backplane connector 114.

Figure 4A:
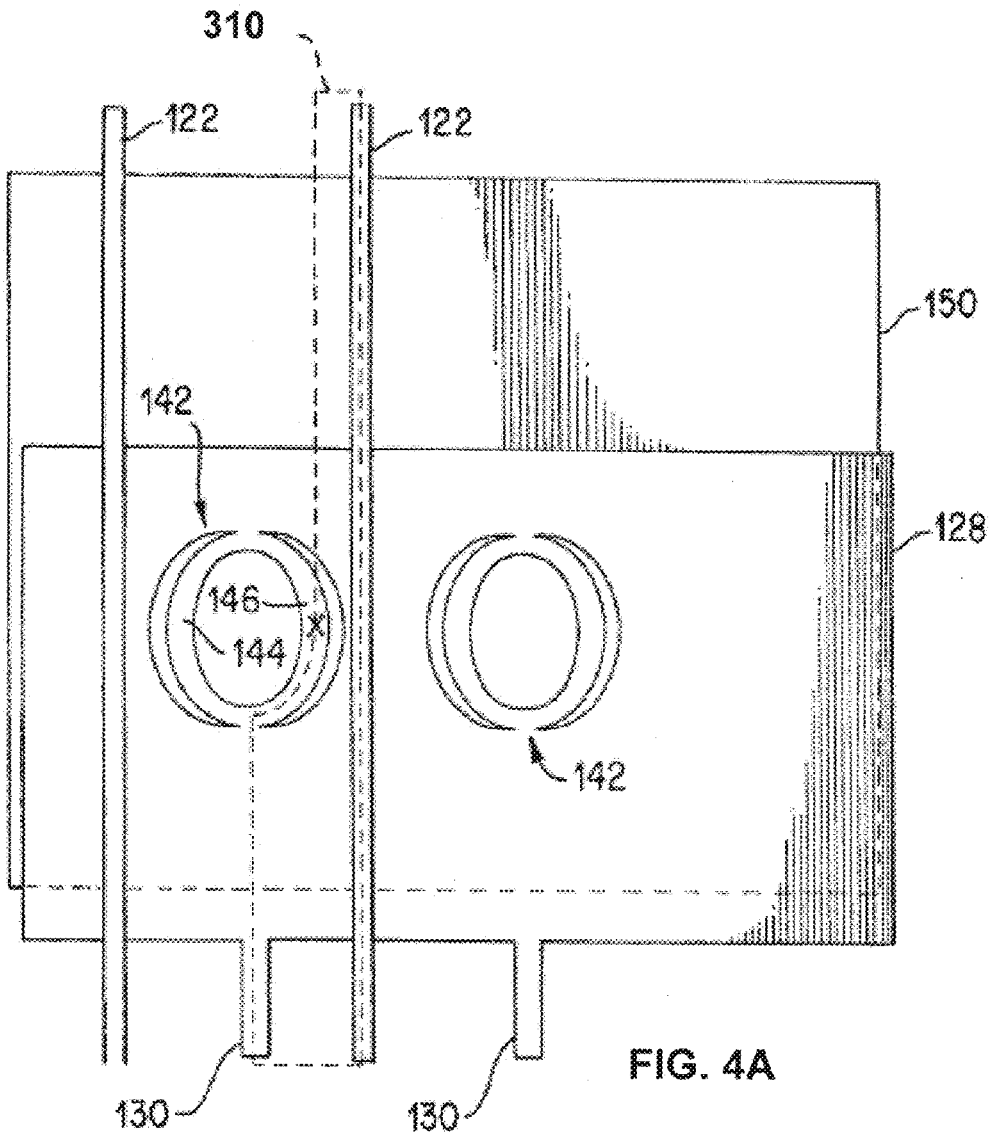
FIG. 4A shows, schematically, an illustrative signal path in an electrical interconnection system, in accordance with some embodiments.

FIG. 4A shows, schematically, an illustrative signal path 310 in an electrical interconnection system (e.g., the system 100 in the example of FIG. 1B), in accordance with some embodiments. For example, the signal path 310 may pass through one of the signal conductors 122 of the backplane connector 114 of the example shown in FIG. 1B, return through the shield plate 150 of the daughter card connector 116 to a point of contact X between the shield plate 150 and the arm 146 of the shield plate 128 of the backplane connector 114, and then through the arm 146, the shield plate 128, and the tail 130. Finally, the signal path 310 may be completed through the backplane 110 shown in FIG. 1B. In this manner, the signal path 310 may not cut through any adjacent one of the signal conductors 122, so that crosstalk may be reduced.

Figure 4B:
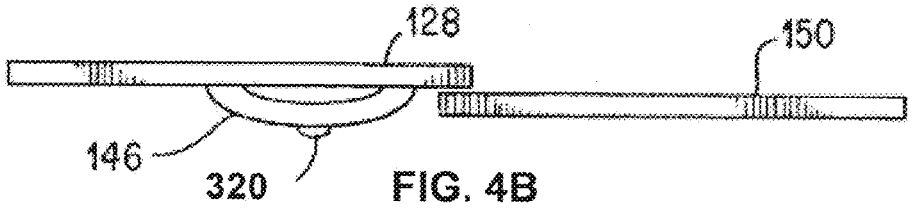
FIG. 4B shows, schematically, an illustrative torsional beam contact suitable for use in a shield plate, in accordance with some embodiments.

FIG. 4B shows, schematically, an illustrative torsional beam contact suitable for use in a shield plate, in accordance with some embodiments. For example, such a torsional beam contact may be used in the shield plate 128 of the backplane connector 114 of the example shown in FIG. 1B.

In the example shown in FIG. 4B, the arm 146 of the shield plate 128 is bent out of the plane of the shield plate 128. The shield plate 128 may be positioned and adapted to slide along the shield plate 150 of the daughter card connector 116 when the backplane connector 114 is mated with the daughter card connector 116. As the shield plates 150 and 128 slide along one another, the arm 146 may be pressed back into the plane of the shield plate 128.

Figure 4C:
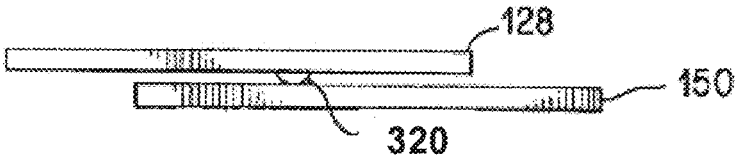
FIG. 4C shows the illustrative shield plates of FIG. 4B in a mated configuration, in accordance with some embodiments.

FIG. 4C shows the illustrative shield plates 128 and 150 of FIG. 4B in a mated configuration, in accordance with some embodiments. In the example shown in FIG. 4C, the arm 146 is pressed back into the plane of the shield plate 128 of the backplane connector 114 by the shield plate 150 of the daughter card connector 116. In some embodiments, a dimple 320 formed on the arm 146 may be positioned and adapted to be in contact with the shield plate 150 in this mated configuration. The torsional spring force generated by pressing the arm 146 back into the plane of the shield plate 128 may facilitate a good electrical contact between the dimple 320 and the shield plate 150. However, it should be appreciated that other types of contacts between the shield plates 128 and 150 are also possible, such as cantilevered beam contacts, as aspects of the present disclosure are not limited to any particular contact interface between two shield members.

Wafers with various configurations may be formed in any suitable way, as aspects of the present disclosure are not limited to any particular manufacturing method. FIG. 5A shows illustrative wafer strip assemblies 410A and 410B suitable for use in making a wafer, in accordance with some embodiments. For example, the wafer strip assemblies 410A-B may be used in making the wafer 154 in the example of FIG. 1B. Moreover, it should be appreciated that mating contract structures disclosed herein may be incorporated into electrical connectors whether or not manufactured using wafers.

In the example of FIG. 5A, the wafer strip assemblies 410A-B each includes conductive elements in a configuration suitable for use as one column of conductors in a daughter card connector (e.g., the daughter card connector 116 in the example of FIG. 1B). A housing may then be molded around the conductive elements in each wafer strip assembly in an insert molding operation to form a wafer.

To facilitate the manufacture of wafers, signal conductors (e.g., signal conductor 420) and ground conductors (e.g., ground conductor 430) may be held together on a lead frame, such as the illustrative lead frame 400 in the example of FIG. 5A. For example, the signal conductors and the ground conductors may be attached to one or more carrier strips, such as the illustrative carrier stripes 402 shown in FIG. 5A.

In some embodiments, conductive elements (e.g., in single-ended or differential configuration) may be stamped for many wafers from a single sheet of conductive material. The sheet may be made of metal or any other material that is conductive and provides suitable mechanical properties for conductive elements in an electrical connector. Phosphor-bronze, beryllium copper and other copper alloys are non-limiting example of materials that may be used.

FIG. 5A illustrates a portion of a sheet of conductive material in which the wafer strip assemblies 410A-B have been stamped. Conductive elements in the wafer strip assemblies 410A-B may be held in a desired position by one or more retaining features (e.g., tie bars 452, 454 and 456 in the example of FIG. 5A) to facilitate easy handling during the manufacture of wafers. Once material is molded around the conductive elements to form housings, the retaining features may be disengaged. For example, the tie bars 452, 454 and 456 may be severed, thereby providing electronically separate conductive elements and/or separating the wafer strip assemblies 410A-B from the carrier strips 402. The resulting individual wafers may then be assembled into daughter board connectors.

In the example of FIG. 5A, ground conductors (e.g., the ground conductor 430) are wider compared to signal conductors (e.g., the signal conductor 420). Such a configuration may be suitable for carrying differential signals, where it may be desirable to have the two signal conductors within a differential pair disposed close to each other to facilitate preferential coupling. However, it should be appreciated that aspects of the present disclosure are not limited to the use of differential signals. Various concepts disclosed herein may alternatively be used in connectors adapted to carry single-ended signals.

Although the illustrative lead frame 400 in the example of FIG. 5A has both ground conductors and signal conductors, such a construction is not required. In alternative embodiments, ground and signal conductors may be formed in two separate lead frames, respectively. In yet some embodiments, no lead frame may be used, and individual conductive elements may instead be employed during manufacture. Additionally, in some embodiments, no insulative material may be molded over a lead frame or individual conductive elements, as a wafer may be assembled by inserting the conductive elements into one or more preformed housing portions. If there are multiple housing portions, they may be secured together with any suitable one or more attachment features, such as snap fit features.

The wafer strip assemblies shown in FIG. 5A provide just one illustrative example of a component that may be used in the manufacture of wafers. Other types and/or configurations of components may also be suitable. For example, a sheet of conductive material may be stamped to include one or more additional carrier strips and/or bridging members between conductive elements for positioning and/or support of the conductive elements during manufacture. Accordingly, the details shown in FIG. 5A are merely illustrative and are non-limiting.

Figure 5B:
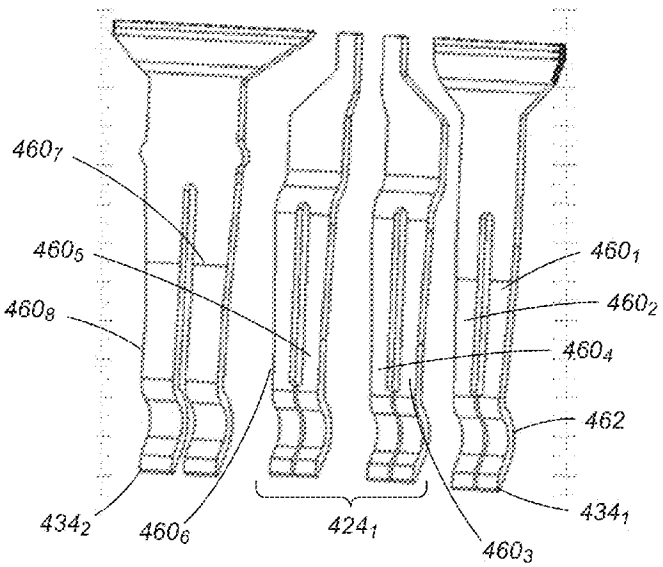
FIG. 5B is an enlarged detail view of the area encircled by arrow 5B-5B in FIG. 4A, in accordance with some embodiments.
Figure 5A:
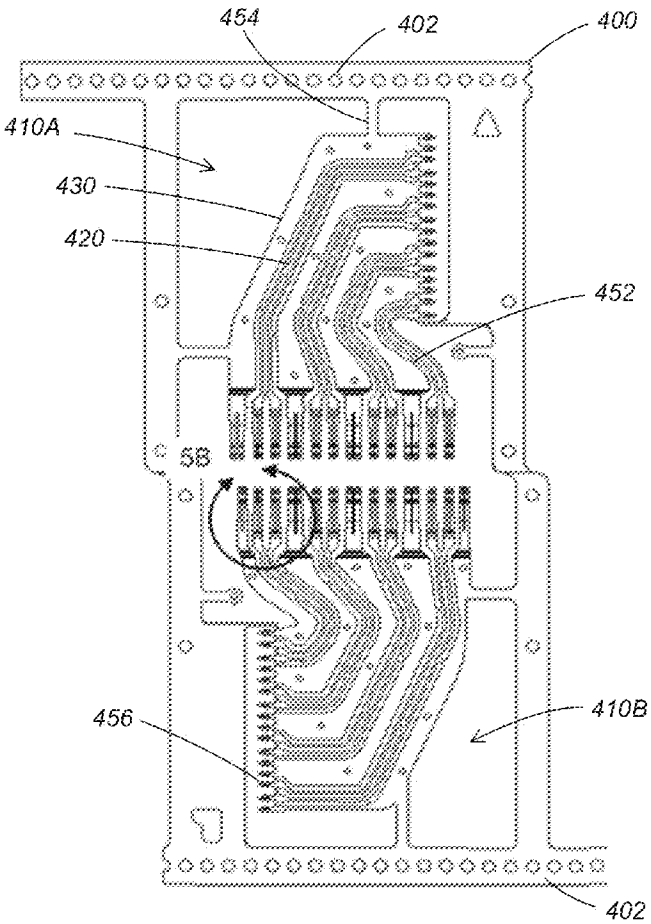
FIG. 5A is a plan view of an illustrative lead frame used in the manufacture of a connector, in accordance with some embodiments.

FIG. 5B is a detailed view of a group of mating contacts of the illustrative wafer strip assembly 410B at the region circled by the arrow 5B-5B shown in FIG. 5A, in accordance with some embodiments. In this example, the group of mating contacts include a pair of mating contacts $\mathbf{424}_1$ positioned between two other mating contacts $\mathbf{434}_1$ and $\mathbf{434}_2$. The mating contact pair $\mathbf{424}_1$ may be mating contacts of two conductors adapted to carry a differential signal, whereas the mating contacts $\mathbf{434}_1$ and $\mathbf{434}_2$ may be those of ground conductors. However, it should be appreciated that aspects of the present disclosure are not limited to the use of differential signals. Various concepts disclosed herein may alternatively be used in connectors adapted to carry single-ended signals.

In the example of FIG. 5B, the ground conductors may have mating contacts of different sizes. For example, the mating contact $\mathbf{434}_2$ may be wider than the mating contact $\mathbf{434}_1$. To reduce the size of a wafer, smaller mating contacts such as the mating contact $\mathbf{434}_1$ may be positioned on one or both ends of the wafer. However, it should be appreciated that aspects of the present disclosure are not limited to mating contacts of any particular size.

In some embodiments, one or more of the mating contacts of conductive elements in a daughter card connector may have a dual beam structure. For example, the illustrative mating contact $\mathbf{434}_1$ in the example of FIG. 5B includes beams $\mathbf{460}_1$ and $\mathbf{460}_2$, and the illustrative mating contact $\mathbf{434}_2$ includes two beams $\mathbf{460}_7$ and $\mathbf{460}_8$. Likewise, the illustrative mating contact pair $\mathbf{424}_1$ in the example of FIG. 5B includes four beams, two for each of the signal conductors of the differential pair. In particular, in this example, beams $\mathbf{460}_3$ and $\mathbf{460}_4$ are associated with one signal conductor of the pair and beams $\mathbf{460}_5$ and $\mathbf{460}_6$ are associated with the other signal conductor of the pair.

In the example of FIG. 5B, each of the contact beams includes a mating surface, of which mating surface 462 on the beam $\mathbf{460}_1$ is numbered. To form a reliable electrical connection between a conductive element in the daughter card connector 116 and a corresponding conductive element in the backplane connector 114, each of the beams $\mathbf{460}_1 \ldots \mathbf{460}_8$ may be shaped to press against a corresponding mating contact in the backplane connector 114 with sufficient mechanical force. Having two beams per contact increases the likelihood that an electrical connection will be formed even if one beam is damaged, contaminated or otherwise precluded from making an effective connection. However, aspect of the present disclosure are not limited to the use of dual-beam contacts, as other types of contacts may also be suitable. Examples of suitable contact designs are discussed in greater detail below.

It should be appreciated that some or all of the concepts discussed above in connection with daughter card connectors for providing desirable characteristics may also be employed in the backplane connectors. For example, in some embodiments, signal conductors in a backplane connector (e.g., the backplane connector 114 in the example of FIG. 1B) may be arranged in columns, each containing differential pairs interspersed with ground conductors. The ground conductors may be wider relative to the signal conductors. Also, adjacent columns may have different configurations. For example, in some embodiments, some of the columns may have narrow ground conductors at one end or both ends to save space, while providing a desired ground configuration around signal conductors. Additionally, ground conductors in one column may be positioned adjacent to corresponding differential pairs in an adjacent column, which may reduce crosstalk from one column to the next. Furthermore, lossy material may be selectively placed within the shroud of a backplane connector (e.g., the illustrative shroud 120 in the example of FIG. 1B) to reduce crosstalk, without causing an undesirable level of attenuation for signals. For example, lossy material may be selectively placed in strips or portions of any suitable size adjacent a mating contact portion of a connector. Further still, adjacent signal conductors and ground conductors may have conforming portions so that in locations where the profile of either a signal conductor or a ground conductor changes, the signal-to-ground spacing may be maintained.

Figure 6:
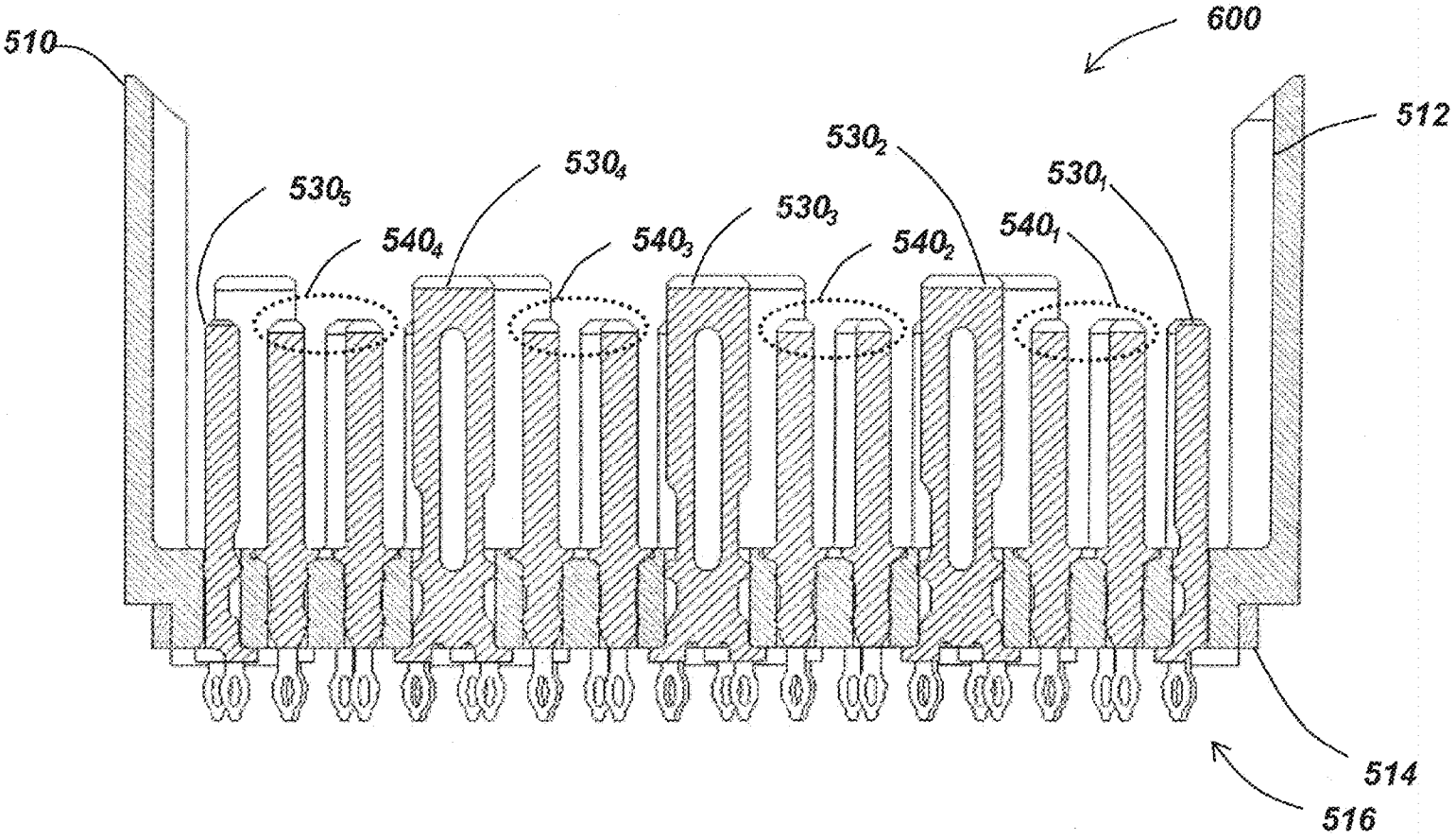
FIG. 6 is a cross-sectional view of an illustrative backplane connector, in accordance with some embodiments.

FIG. 6 shows a cross section of an illustrative backplane connector 600, in accordance with some embodiments. For instance, the backplane connector 600 may be the backplane connector 114 in the example shown in FIG. 1B.

In the example shown in FIG. 6, the backplane connector 600 includes a shroud 510 with walls 512 and a floor 514. In some embodiments, conductive elements may be inserted into the shroud 510 and may have portions extending above the floor 514, such as portions $\mathbf{530}_1 \ldots \mathbf{530}_5$ and $\mathbf{540}_1 \ldots \mathbf{540}_4$. In some embodiments, these portions may be adapted to form electrical connections with corresponding mating contacts (e.g., the mating contacts $\mathbf{424}_1$, $\mathbf{434}_1$, and $\mathbf{434}_2$ in the example of FIG. 5B) in a daughter card connector when the daughter card connector is mated with (e.g., inserted into) the backplane connector 600. The conductive elements may also have portions extending below the floor 514. These portions may form contact tails adapted to be inserted into via holes in a backplane (e.g., the signal holes 136 and/or ground holes 138 in the example shown in FIG. 1B) to make electrical connections with traces in the backplane.

In the example shown in FIG. 6, conductive elements in the backplane connector 600 are arranged in multiple parallel columns. The conductive elements in each column may be positioned and adapted to mate with corresponding conductive elements in a wafer of a daughter card connector when the daughter card connector is inserted into the backplane connector 600. For example, in some embodiments, some of the conductive elements in the backplane connector 600 may form pairs adapted to carry differential signals (e.g., the pairs $\mathbf{540}_1 \ldots \mathbf{540}_4$), while others may be adapted to be grounds (e.g., $\mathbf{530}_1 \ldots \mathbf{530}_5$). Again, it should be appreciated that aspects of the present disclosure are not limited to the use of differential signals. Various concepts disclosed herein may alternatively be used in connectors adapted to carry single-ended signals.

Figure 7B:
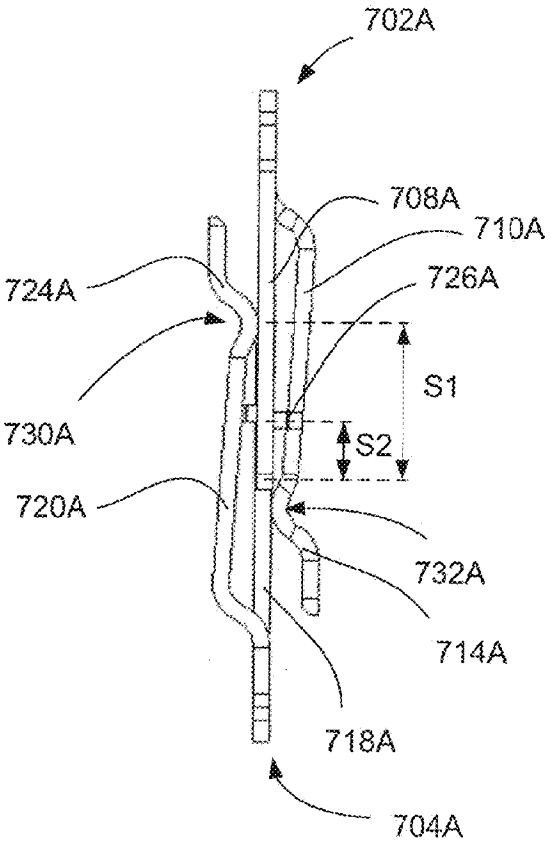
FIG. 7B is a side view of the illustrative contacts in the example of FIG. 7A, in accordance with some embodiments.
Figure 7A:
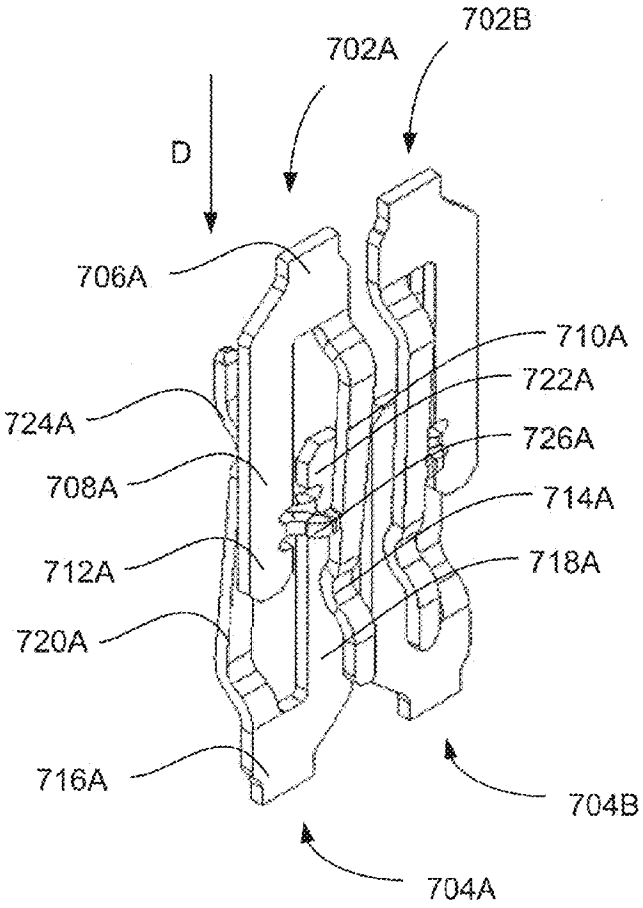
FIG. 7A shows a pair of illustrative contacts mated respectively with another pair of illustrative contacts, in accordance with some embodiments.

FIG. 7A shows a pair of illustrative contacts 702A and 702B mated respectively with a like pair of contacts 704A and 704B, in accordance with some embodiments. For example, the contacts 702A-B may be mating contacts of conductive elements in a daughter card connector (e.g., the daughter card connector 116 in the example of FIG. 1B), and the contacts 704A-B may be mating contacts of conductive elements in a backplane connector (e.g., the backplane connector 114 in the example of FIG. 1B), or vice versa.

The illustrative contacts shown in FIG. 7A may be used as mating contacts for any suitable type of conductive elements. For example, in some embodiments, the contacts 702A-B and 704A-B may be mating contacts of conductors adapted to carry a differential signal (e.g., two conductors disposed close to each other to facilitate preferential coupling). However, in alternative embodiments, the contacts 702A-B and 704A-B may be mating contacts of two conductors adapted to carry single ended signals. In yet some embodiments, one or both of the contacts 702A-B may be a mating contact of a ground conductor and correspondingly for the contacts 704A-B.

In the example of FIG. 7A, the contact 702A includes a base region 706A. In some embodiments, the contact 702A may be a mating contact of a conductive element extending from an insulative housing (not shown), and the base region 706A may be adjacent the insulative housing. The contact 702A may further include two elongated members 708A and 710A extending from the base region 706A. In this example, the elongated member 708A is configured as a blade having a planar member 712A at the distal end, while the elongated member 710A is configured as a beam having an arced segment 714A at the distal end.

Similarly, in the example of FIG. 7A, the contact 704A may include a base region 716A and two elongated members 718A and 720A. The elongated member 718A may be configured as a blade having a planar member 722A at the distal end, while the elongated member 720A may be configured as a beam having an arced segment 724A at the distal end.

In some embodiments, the contacts 702A and 704A may be mated with each other by sliding one of the contacts relative to the other along a direction that is parallel to the elongated members of the contacts 702A and 704A. For instance, in the example shown in FIG. 7A, the contacts 702A and 704A may be mated with each other by sliding the contact 702A along a direction D, while the contact 704A is held fixed. Alternatively, the contacts 702A and 704A may be mated with each other by sliding the contact 704A opposite the direction D, while the contact 702A is held fixed. Yet another alternative is to slide the contacts 702A and 704A towards each other so that both contacts move relative to some other fixed reference point.

In some embodiments, the elongated member 708A of the contact 702A may be relatively rigid, while the elongated member 710A may be relatively compliant. Likewise, the elongated member 718A of the contact 704A may be relatively rigid, while the elongated member 720A may be relatively compliant. Furthermore, the contact 702A may be aligned with respect to the contact 704A such that when these two contacts slide against each other in opposite directions into a mated position (e.g., as shown in the example of FIG. 7A), a contact surface located on a convex region of the arced segment 714A of the elongated member 710A forms an electrical connection with the elongated member 718A of the contact 704A, and a contact surface located on a convex region of the arced segment 724A of the elongated member 720A forms an electrical connection with the elongated member 708A of the contact 702A. As a result, the elongated member 710A may be deflected and may generate a spring force that presses the arced segment 714A against the elongated member 718A, thereby facilitation good electrical connection between the elongated member 710A and the elongated member 718A. Similarly, the elongated member 720A may be deflected and may generate a spring force that presses the arced segment 724A against the elongated member 708A, thereby facilitation good electrical connection between the elongated member 720A and the elongated member 708A.

In some embodiments, the contact 702A may additionally include a strap 726A coupling the distal end of the elongated member 708A and the distal end of the elongated member 710A. The strap 726A may be compliant, so that the distal end of the elongated member 710A may move independently of the distal end of the elongated member 708A, for example, when the elongated member 710A is deflected during mating of the contacts 702A and 704A. Additionally, the strap 726A may be conductive and therefore may make an electrical connection between the distal end of the elongated member 708A and the distal end of the elongated member 710A.

The strap 702A may be formed in any suitable way, as aspects of the present disclosure are not limited to any particular manufacturing method. For example, in some embodiments, the strap 726A may be a separate piece welded or otherwise attached onto the elongated members 708A and 710A. Similarly, either or both of the elongated members 708A and 710A may be welded or otherwise attached to the base region 706A. In alternative embodiments, the strap 726A and the elongated members 708A and 710A may all be stamped from a same sheet of material (e.g., some suitable metal alloy) and may be bent, stretched, or otherwise worked into desired configurations.

FIG. 7B is a side view of the illustrative contacts 702A and 704A in the example of FIG. 7A, in accordance with some embodiments. In this view, the elongated member 720A of the contact 704A is visible and the arced segment 724A of the elongated member 720A is shown in electrical contact with the elongated member 708A of the contact 702A at a contact region 730A. Thus, the distal end of the elongated member 708A is a distance S1 away from the contact region 730A.

The portion of the elongated member 708A between the distal end and the contact region 730A is sometimes referred to as a "wipe" region. Providing sufficient wipe may help to ensure that adequate electrical connection is made between the contacts 702A and 704A even if the arced segment 724A of the elongated member 720A does not reach an intended contact region of the elongated member 708A due to manufacturing and/or assembly variances. However, the inventors have also recognized and appreciated that a wipe region may form an unterminated stub when electrical currents flow between mated contacts of two connectors. The presence of such an unterminated stub may lead to unwanted resonances, which may lower the quality of the signals carried through the mated connectors.

In some embodiments, the strap 726A coupling the distal end of the elongated member 708A and the distal end of the elongated member 710A may provide a structure to reduce an unterminated stub on the elongated member 708A while still providing sufficient wipe to ensure adequate electrical connection. In the example shown in FIG. 7B, the arced segment 714A of the elongated member 710A is in electrical contact with the elongated member 718A of the contact 704A at a contact region 732A. As a result, when the contacts 702A and 704A are mated together, electrical current may flow through the portion of the elongated member 710A that is above the contact region 732A. By connecting the distal end of the elongated member 708A with the portion of the elongated member 710A that is above the contact region 732A, the strap 726A may allow electrical current to flow through a portion of the elongated member 708A between the strap 726A and the contact region 730A, thereby reducing the unterminated stub length from S1 to S2.

Figure 7C:
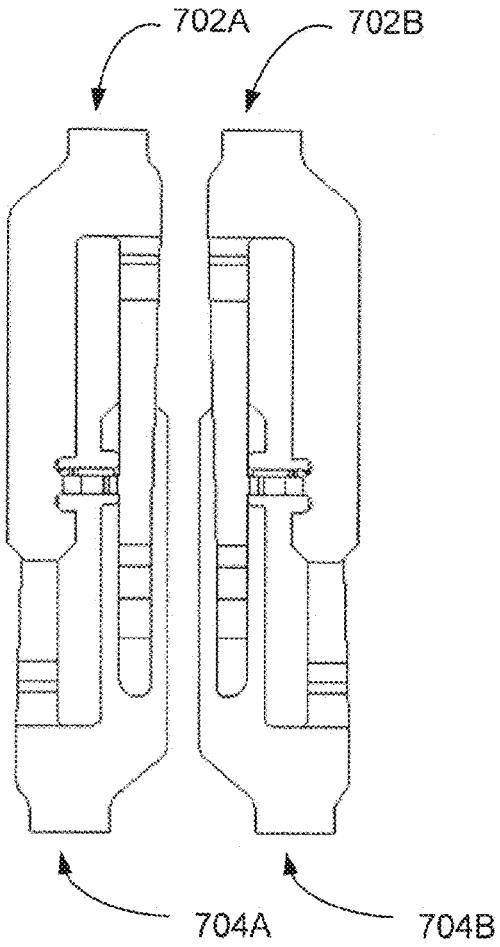
FIG. 7C is a front view of the illustrative contacts in the example of FIG. 7A, in accordance with some embodiments.

FIG. 7C is a front view of the illustrative contacts 702A-B and 704A-B in the example of FIG. 7A, in accordance with some embodiments. As seen in this view, the contact 702B may be a minor image of the contact 702A, and the contact 704B may be a minor image of the contact 704A. However, it should be appreciated that adjacent contacts need not be minor images of each other, as other configurations may also be suitable. For example, a pair of identical contacts may be used, or contacts that are neither identical, nor mirror images of each other.

Figure 8B:
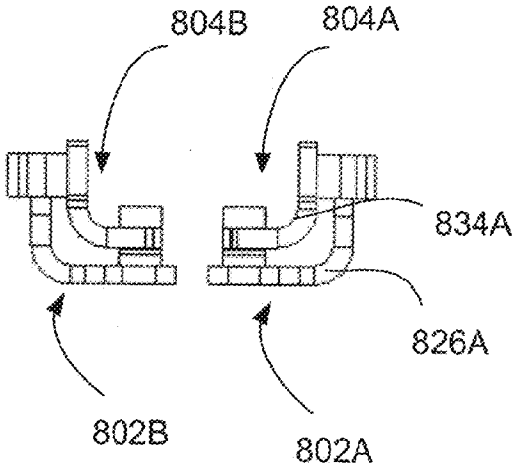
FIG. 8B is a bottom view of the illustrative contacts in the example of FIG. 8A, in accordance with some embodiments.
Figure 8A:
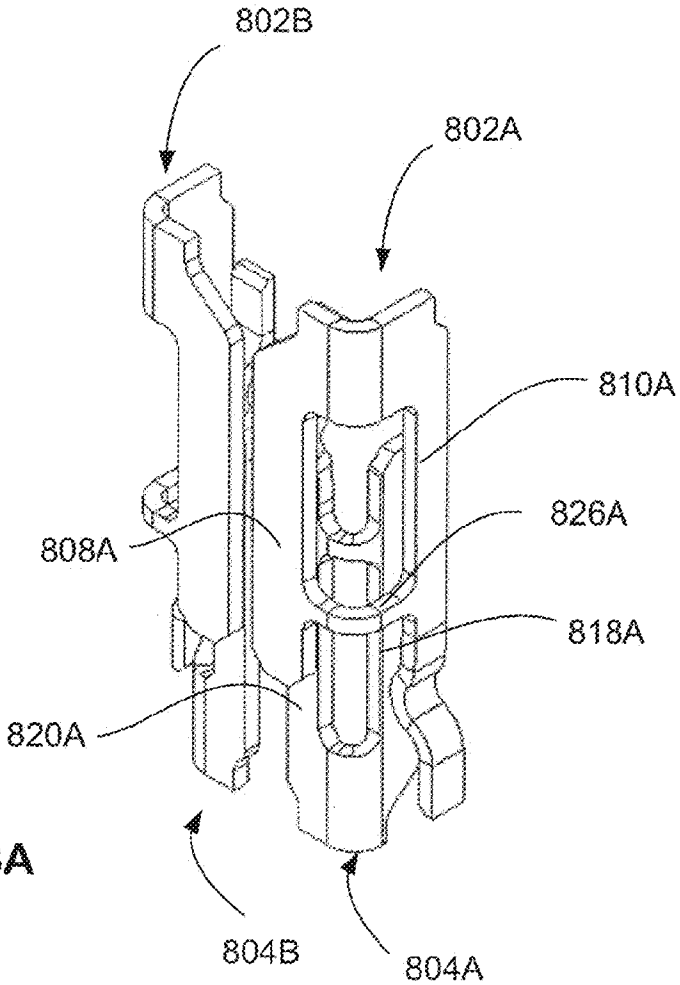
FIG. 8A shows a pair of illustrative contacts mated respectively with another pair of illustrative contacts, in accordance with some embodiments.

FIG. 8A shows an pair of illustrative contacts 802A and 802B mated respectively with another pair of illustrative contacts 804A and 804B, in accordance with some embodiments. In this example, the contact 802A includes two elongated members 808A and 810A, which may be similar to the elongated members 708A and 710A of the contact 702A in the example of FIG. 7A. However, unlike the elongated members 708A and 710A which are generally parallel, the elongated members 808A and 810A may lie in different planes that intersect each other. For instance, in the example shown in FIG. 8A, the elongated members 808A and 810A lie in orthogonal planes. However, it should be appreciated that a right angle between the elongated members 808A and 810A is not required, as other angles may also be suitable.

Having the elongated members 808A and 810A disposed at an angle from each other may have one or more benefits. For example, an overall width of the contact 802A may be reduced, so that more contacts like the contact 802A may fit into a column of contacts having a fixed width. This may allow higher signal density in a connector, even though an overall thickness of the contact 802A may be increased at the same time. As another example, having the elongated members 808A and 810A disposed at an angle from each other may allow the elongated members 808A and 810A to be made smaller and/or disposed further away from each other, so as to increase the ratio between air and conductive material at the mating interface between a backplane connector and a daughter card connector. This may lead to a decrease in impedance and as a result improved signal quality (e.g., when the connectors operate at a high data rate, such as 1.25, 6.25, 10, 20, 25, 30, 35, 40, or 45 Gbits/second, and/or a high frequency, such as 4, 7.5, 18, 25, 30, 40, 50, GHz).

Additionally, reducing the size of mating contacts may allow more space in which one or more shield members may be placed around one or more of the mating contacts, which may also improve signal quality. However, as noted above, the presence more metal and/or less air at the mating interface may increase impedance. Accordingly, a tradeoff may be made between providing more shielding and reducing the amount of metal at the mating interface.

In some embodiments, the amount of metal used at the mating interface may be reduced by using composite shield members. For example, a composite shield may be made by plating metal over electrically conductive plastic. The metal plating may provide shielding, while the conductive plastic may dampen unwanted resonances from the metal plating. Because the metal plating can be made very thin, the use of such composite shields may provide space savings over alternative designs with plastic molded over metal shields. Additionally, the metal plating on a composite shield may be coupled to ground, so that no separate ground conductor may be used, which may provide further space savings. However, it should be appreciated that aspects of the present disclosure are not limited to the use of composite shield members with metal plating, nor to the use of shields at all.

In some embodiments, the positioning of metal shields may be controlled using selective plating techniques. For example, precise areas on a piece of conductive plastic at which shielding is desired may be activated in some suitable fashion (e.g., using a laser), so that metal plating attaches only to the activated areas. Examples of selective plating techniques can be found in United States Patent Application Publication No. 2010/0323109, which is incorporated herein by reference in its entirety. However, it should be appreciated that aspects of the present disclosure are not limited to the use of those techniques, nor to the use of selective plating at all.

In the example shown in FIG. 8A, the contact 804A also includes two elongated members 818A and 820A, which may be similar to the elongated members 718A and 720A of the contact 704A in the example of FIG. 7A. As the elongated members 808A and 810A of the contact 802A lie in orthogonal planes, the elongated members 820A and 818A may have a similar configuration so as to be aligned respectively with the elongated members 808A and 810A.

FIG. 8B is a bottom view of the illustrative contacts 802A-B and 804A-B in the example of FIG. 8A, in accordance with some embodiments. As seen in this view, the contact 804A may be sized and/or shaped to fit inside a corner or nook formed by the elongated members of the contact 802A. A strap 834A connecting the elongated members of the contact 804A may therefore be shorter than a strap 826A connecting the elongated members of the contact 802A.

Figure 8D:
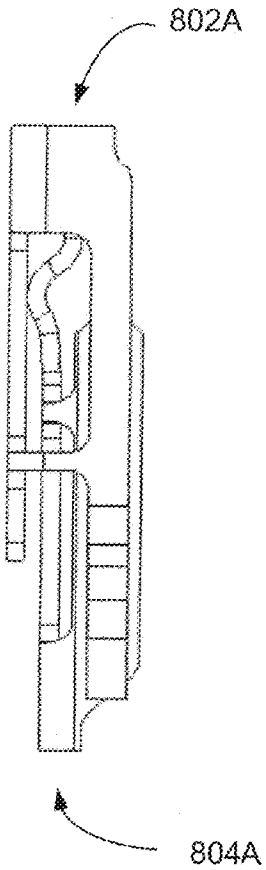
FIG. 8D is a side view of the illustrative contacts in the example of FIG. 8A, in accordance with some embodiments.
Figure 8C:
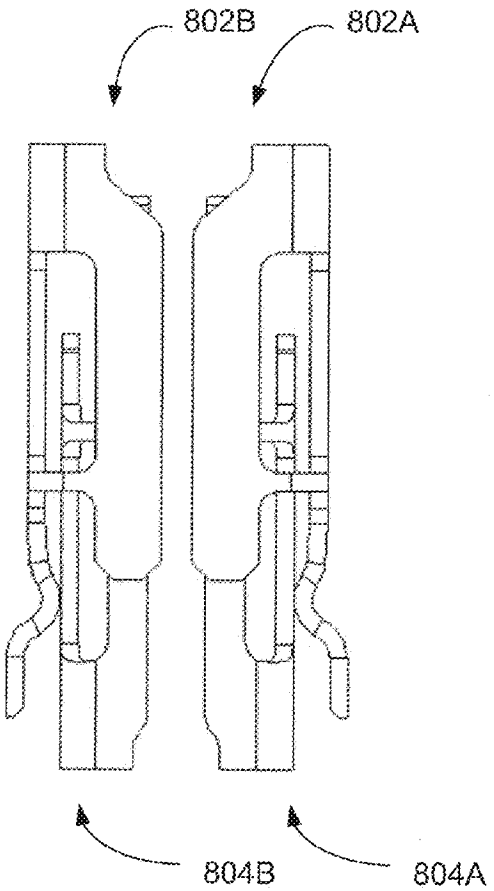
FIG. 8C is a front view of the illustrative contacts in the example of FIG. 8A, in accordance with some embodiments.

FIG. 8C is a front view of the illustrative contacts 802A-B and 804A-B in the example of FIG. 8A, in accordance with some embodiments. As seen in this view, the contact 802B may be a minor image of the contact 802A, and the contact 804B may be a minor image of the contact 804A. Again, it should be appreciated that adjacent contacts need not be minor images of each other, as other configurations may also be suitable, such as identical contacts, or contacts that are neither identical, nor minor images of each other.

FIG. 8D is a side view of the illustrative contacts 802A and 804A in the example of FIG. 8A, in accordance with some embodiments.

Figure 9A:
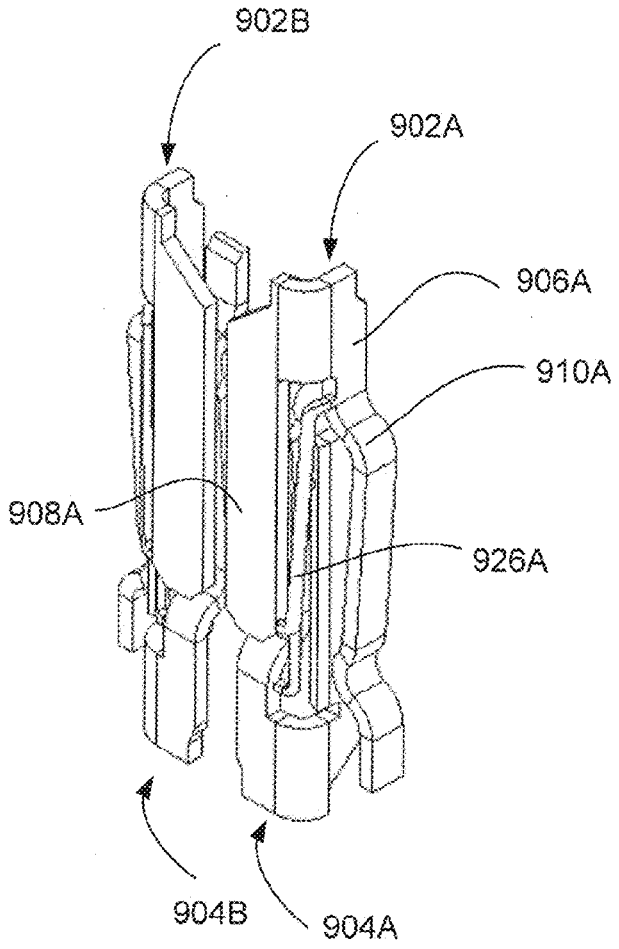
FIG. 9A shows a pair of illustrative contacts mated respectively with another pair of illustrative contacts, in accordance with some embodiments.

FIG. 9A shows an pair of illustrative contacts 902A and 902B mated respectively with another pair of illustrative contacts 904A and 904B, in accordance with some embodiments. In this example, the contact 902A includes two elongated members 908A and 910A, which may be similar to the elongated members 808A and 810A of the contact 802A in the example of FIG. 8A. However, a strap 926A may connect the elongated members 908A and 910A at locations different from where the strap 826A connects the elongated members 808A and 810A in the example of FIG. 8A. For instance, in the example of FIG. 9A, the strap 926A may be coupled to the elongated member 908A at the distal end so as to completely or almost completely eliminate any unterminated stub on the elongated member 908A. In addition, the strap 926A may be coupled to the elongated member 910A at the proximal end, near a base region 906A of the contact 902A.

Figure 9B:
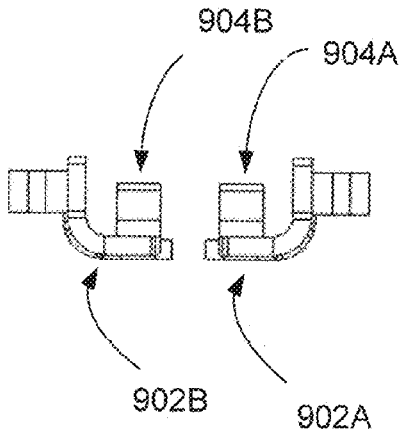
FIG. 9B is a bottom view of the illustrative contacts in the example of FIG. 9A, in accordance with some embodiments.

FIG. 9B is a bottom view of the illustrative contacts 902A-B and 904A-B in the example of FIG. 9A, in accordance with some embodiments. As seen in this view, the contact 904A may be sized and/or shaped to fit inside a corner or nook formed by the elongated members of the contact 902A.

Figure 9C:
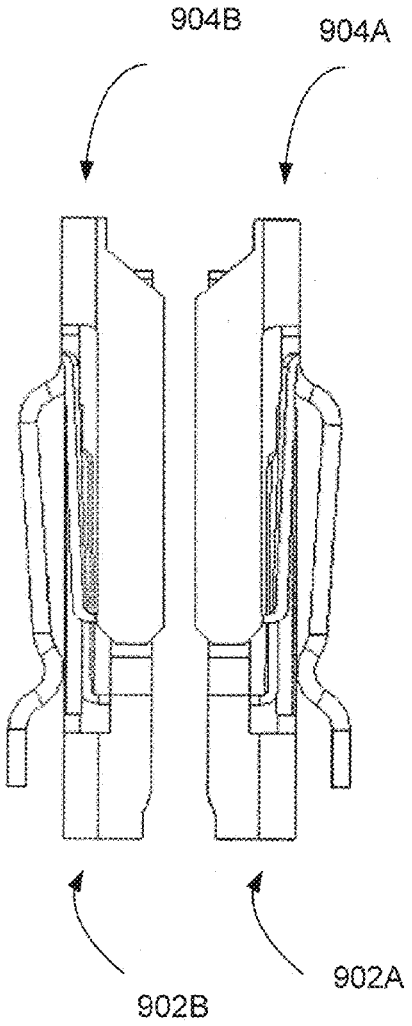
FIG. 9C is a front view of the illustrative contacts in the example of FIG. 9A, in accordance with some embodiments.

FIG. 9C is a front view of the illustrative contacts 902A-B and 904A-B in the example of FIG. 9A, in accordance with some embodiments. As seen in this view, the contact 902B may be a minor image of the contact 902A, and the contact 904B may be a minor image of the contact 904A. Again, it should be appreciated that adjacent contacts need not be minor images of each other, as other configurations may also be suitable, such as identical contacts, or contacts that are neither identical, nor minor images of each other.

Figure 10B:
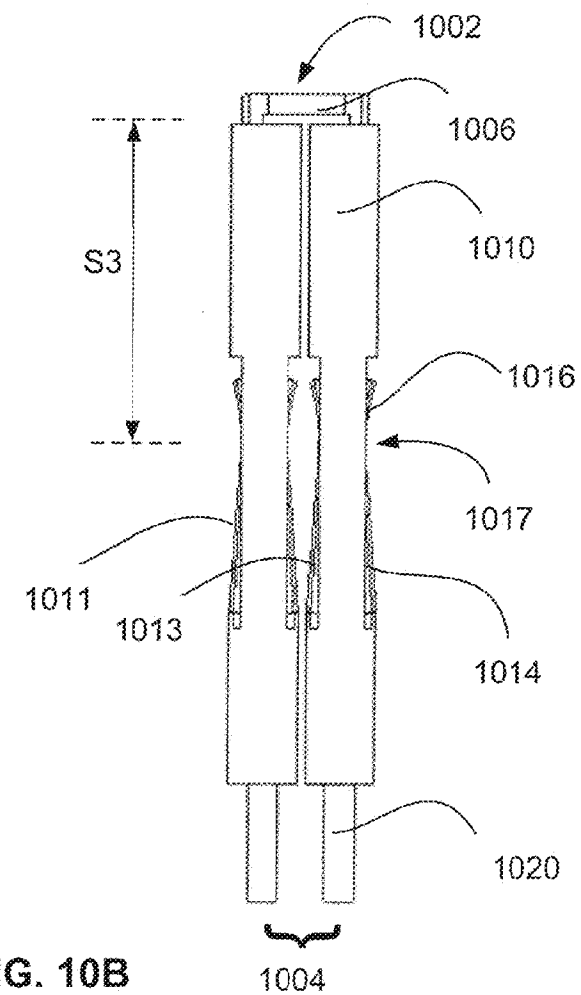
FIG. 10B is a front view of the illustrative contacts in the example of FIG. 10A, in accordance with some embodiments.
Figure 10A:
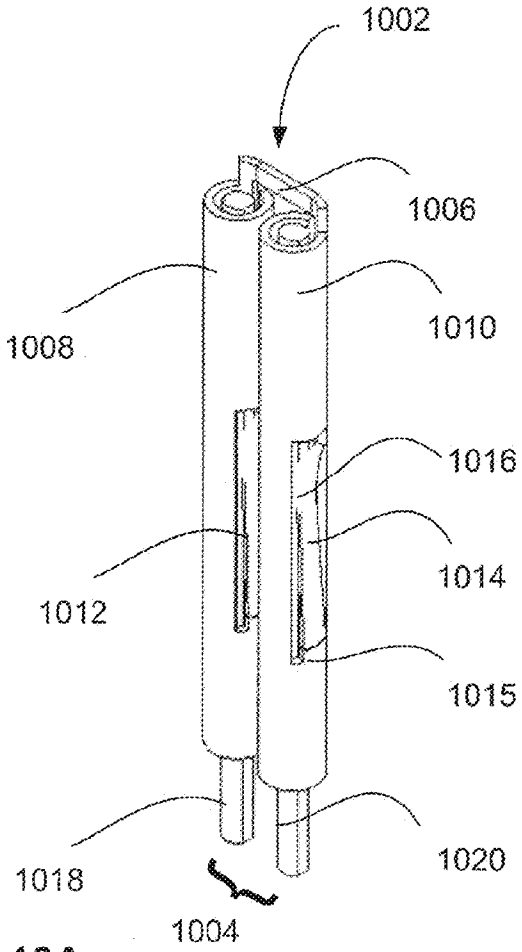
FIG. 10A shows an illustrative contact mated another illustrative contact, in accordance with some embodiments.

FIG. 10A shows an illustrative contact 1002 mated with another contact 1004, in accordance with some embodiments. For example, the contact 1002 may be a mating contact for a conductive element in a daughter card connector (e.g., the daughter card connector 116 in the example of FIG. 1B), and the contact 1004 may be a mating contact of a conductive element in a backplane connector (e.g., the backplane connector 114 in the example of FIG. 1B), or vice versa.

The illustrative contacts shown in FIG. 10A may be used as mating contacts for any suitable type of conductive elements. For example, in some embodiments, the contacts 1002 and 1004 may be mating contacts of conductors adapted to carry a differential signal. However, in alternative embodiments, the contacts 1002 and 1004 may be mating contacts of conductors adapted to carry single ended signals. In yet some embodiments, the contacts 1002 and 1004 may be mating contacts of ground conductors.

In the example of FIG. 10A, the contact 1002 includes a bridge region 1006. In some embodiments, the contact 1006 may be a mating contact of a conductive element extending from an insulative housing (not shown), and the bridge region 1006 may be adjacent the insulative housing. The contact 1002 may further include two elongated members 1008 and 1010 extending from the bridge region 1006. In this example, each of the elongated members 1008 and 1010 is configured as a tube having one or more tabs formed thereon. For example, the elongated member 1008 has a tab 1012 formed on one side, and may have another tab 1011 (not visible in FIG. 10A but shown in FIG. 10B) formed on the opposite side. Likewise, the elongated member 1010 has a tab 1014 formed on one side, and may have another tab 1013 (not visible in FIG. 10A but shown in FIG. 10B) formed on the opposite side.

The elongated members 1008 and 1010 may be formed in any suitable way, as aspects of the present disclosure are not limited to any particular method of manufacturing. For example, in some embodiments, the elongated members 1008 and 1010 may be formed by rolling pliable sheets of conductive material (e.g., a suitable metal alloy) into tubes. In alternative embodiments, the elongated members 1008 and 1010 may be made from drawn tubes of conductive material, and one or more other pieces (e.g., the bridge region 1006) may be welded or otherwise attached onto either or both of the elongated members 1008 and 1010.

The tabs 1012 and 1014 may also be formed in any suitable fashion. For example, in some embodiments, the tab 1014 may be stamped from the same sheet of conductive material as the elongated member 1010 and may remain attached to the elongated member 1010 at a base region 1015. In alternative embodiments, the tab 1014 may be a separate piece welded or otherwise attached to the elongated member 1010.

In the example show in FIG. 10A, the tabs 1012 and 1014 may be configured to respectively engage elongated members 1018 and 1020 of the contact 1004 to form electrical connections. In this example, the elongated members 1018 and 1020 are configured as pins, which may be relatively rigid. As the elongated members 1018 and 1020 are inserted respectively into the elongated members 1008 and 1010, the elongated members 1018 and 1020 may deflect the tabs 1012 and 1014, thereby generating spring forces that press the tabs 1012 and 1014 against the elongated members 1018 and 1020, respectively, to form reliable electrical connections.

In the example of FIG. 10A, the tab 1014 has an arced segment 1016 at a distal end, and a convex region of the arced segment 1016 may be in electrical contact with the elongated member 1020 when the elongated members 1010 and 1020 are mated. In some embodiments, the surface of the convex region of the arced segment 1016 may be coated with a suitable material, for example, to improve electrical properties. Any suitable material may be used, such as gold, silver, etc., or some suitable alloy. Additionally, the coated material may be ductile. In some embodiments, a region on the inner surface the elongated member 1020 that comes into contact with the tab 1014 may be coated with the same or a different material in addition to, or instead of, the coating on the tab 1014.

FIG. 10B is a side view of the illustrative contacts 1002 and 1004 in the example of FIG. 10A, in accordance with some embodiments. In this view, the arced segment 1016 of the elongated member 1010 is shown in electrical contact with the elongated member 1020 at a contact region 1017. Thus, if the elongated member 1020 extends towards the top of the elongated member 1010 (e.g., near the bridge region 1006), an unterminated stub of length S3 may result. However, resonances from the unterminated stub may be shielded completely or almost completely by the elongated member 1010, because the elongated member 1020 is enclosed by the elongated member 1010.

Figure 10C:
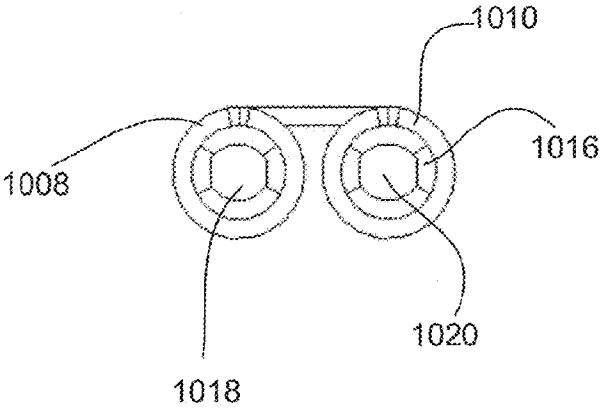
FIG. 10C is a bottom view of the illustrative contacts in the example of FIG. 10A, in accordance with some embodiments.

FIG. 10C is a bottom view of the illustrative contacts 1002 and 1004 in the example of FIG. 10A, in accordance with some embodiments. In this view, the elongated member 1018 is seen being enclosed by the elongated member 1008, and the elongated member 1020 is seen being enclosed by the elongated member 1010. Additionally, the arced segment 1016 of the tab 1014 of the elongated member 1010 is seen being in contact with the elongated member 1020.

Figure 11A:
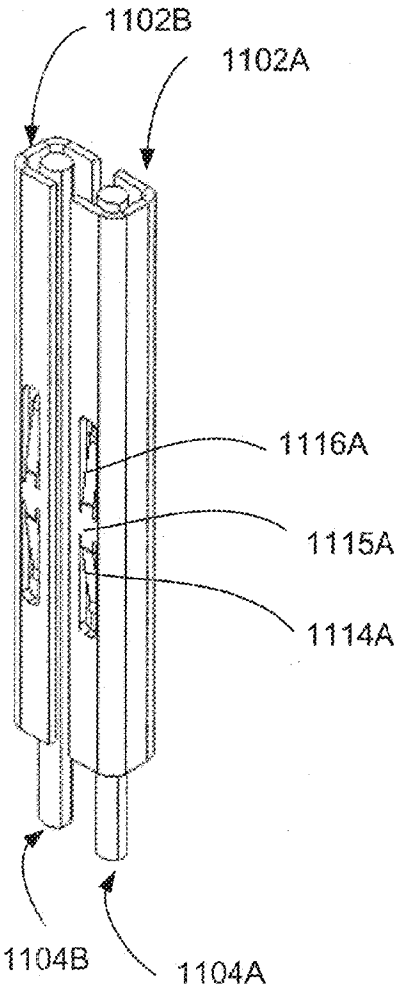
FIG. 11A shows a pair of illustrative contacts mated respectively with another pair of illustrative contacts, in accordance with some embodiments.

FIG. 11A shows a pair of illustrative contacts 1102A and 1102B mated respectively with another pair of illustrative contacts 1104B and 1104A, in accordance with some embodiments. In this example, each of the contacts 1102A and 1102B is configured as an elongated tube, which may be similar to the elongated member 1008 in the example shown in FIG. 10A and described above. However, the contacts 1102A and 1102B may have a cross section that is not round. Rather, in some embodiments, the cross section may be roughly rectangular. For instance, in the example shown in FIG. 11A, the contacts 1102A and 1102B may have a cross section that is square with rounded corners.

Furthermore, in the example shown in FIG. 11A, the contacts 1102A and 1102B each have only three sides, so that the elongated tubes are open towards each other. In an embodiment in which the contacts 1102A and 1102B are electrically connected, respectively, to a pair of conductors carrying a differential signal, this configuration may allow better coupling of the signals carried by the pair. However, it should be appreciated that aspects of the present disclosure are not limited to the use of differential signals, and the contacts 1102A and 1102B may also be used with conductors adapted to carry single-ended signals, or with ground conductors.

In some embodiments, the contacts 1102A and 1102B may have one or more tabs formed thereon. For instance, in the example shown in FIG. 11A, the contact 1102A has tabs 1114A and 1116A formed on one side. Likewise, the contact 1102B has two tabs (not labeled) formed on one side. However, it should be appreciated that any suitable number of tabs may be used, as aspects of the present disclosure are not limited in this regard.

Additionally, in embodiments in which multiple tabs are used, such tabs may be configured in any suitable manner. For instance, in the example shown in FIG. 11A, the tabs 1114A and 1116A may be in opposite orientations, so that they may share a base region 1115A and their distal ends point away from each other. In alternative embodiments, the tabs may instead have the same orientation. Also, in various embodiments, the tabs may be disposed closer or farther away from each other.

In the example shown in FIG. 11A, the tabs 1114A and 1116A may be configured to engage the contact 1104A to form an electrical connection. In this example, the contacts 1104A and 1104B are configured as pins, which may be relatively rigid. As the contact 1104A is inserted into the contact 1102A, the contact 1104A may deflect the tabs 1114A and 1116A, thereby generating spring forces that press the tabs 1114A and 1116A against the contact 1104A. Having multiple points of contact (e.g., one at the tab 1114A and another at the tab 1116A) may facilitate forming a reliable electrical connection.

Figure 11C:
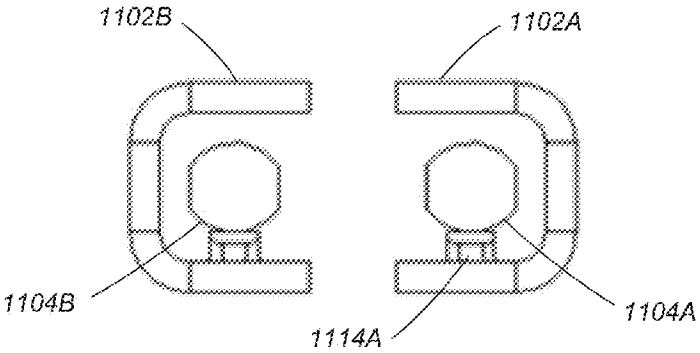
FIG. 11C is a bottom view of the illustrative contacts in the example of FIG. 11A, in accordance with some embodiments.
Figure 11B:
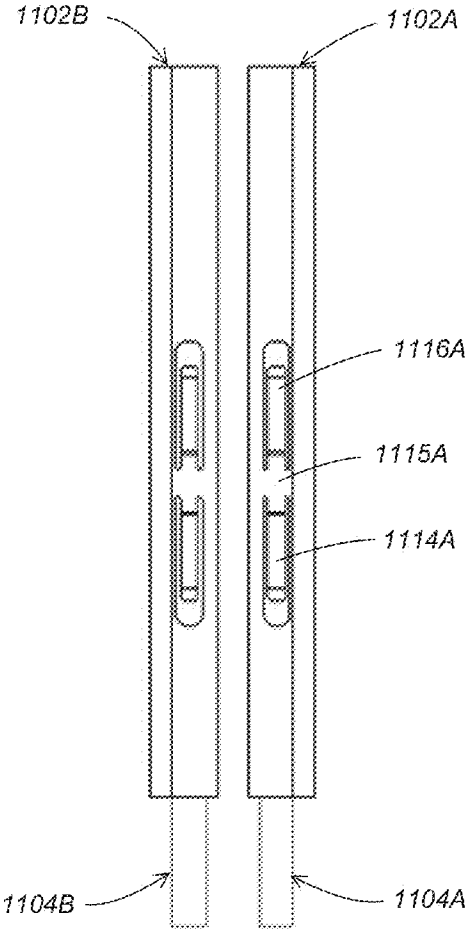
FIG. 11B is a front view of the illustrative contacts in the example of FIG. 11A, in accordance with some embodiments.

FIG. 11B is a front view of the illustrative contacts in the example of FIG. 11A, in accordance with some embodiments.

FIG. 11C is a bottom view of the illustrative contacts in the example of FIG. 11A, in accordance with some embodiments. In this view, the contact 1104A is seen being partially enclosed by the contact 1102A, and the contact 1104B is seen being partially enclosed by the contact 1102B, so that only air is between the contacts 1104A and 1104B. Additionally, the tab 1114A of the contact 1102A is seen being in contact with the contact 1104A.

Figure 12B:
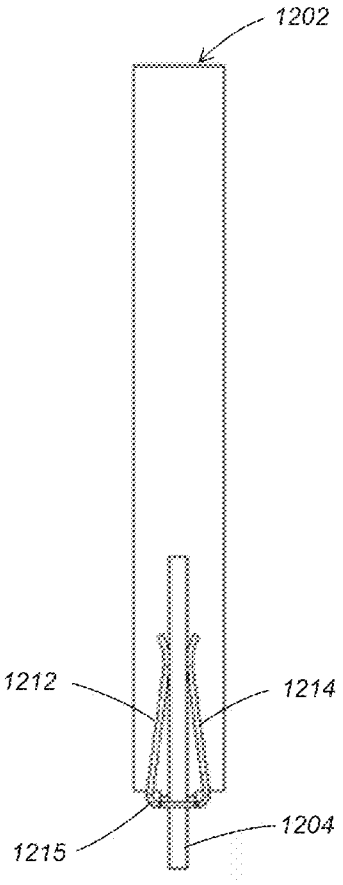
FIG. 12B is a front view of the illustrative contacts in the example of FIG. 12A, in accordance with some embodiments.
Figure 12A:
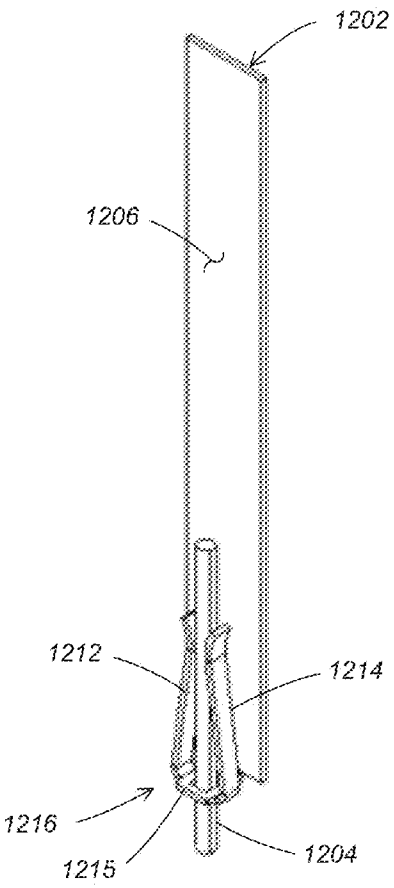
FIG. 12A shows an illustrative contact mated another illustrative contact, in accordance with some embodiments.

FIG. 12A shows an illustrative contact 1202 mated with another contact 1204, in accordance with some embodiments. In this example, the contact 1202 includes an elongated planar portion 1206 connect to a base portion 1215. The base portion 1215 may be perpendicular to the planar portion 1206 and may have an opening 1216 formed therein and configured to receive the contact 1204, so that when the contact 1204 is inserted into the opening 1216, the contact 1204 is generally parallel to the planar portion and may extend along any portion of the length of the planar portion 1206.

In the example of FIG. 12A, the base portion 1216 has attached thereto two beams 1212 and 1214, which may be configured to engage the contact 1204 when the contact 1204 is inserted into the opening 1216. For instance, in some embodiments, the beams 1212 and 1214 may be disposed opposite to each other, so that they engage the contact 1204 at opposite sides when the contact 1204 is inserted into the opening 1216. However, it should be appreciated that aspects of the present disclosure are not limited to any particular configuration of the beams 1212 and 1214.

The contact 1202 may be formed in any suitable manner. For example, any one or more of the planar portion 1206, the base 1216, and the beams 1212 and 1214 may be welded or otherwise attached to another piece. Alternatively, all of these pieces may be stamped from a single sheet of conductive material.

FIG. 12B is a front view of the illustrative contacts in the example of FIG. 12A, in accordance with some embodiments.

Figure 12D:
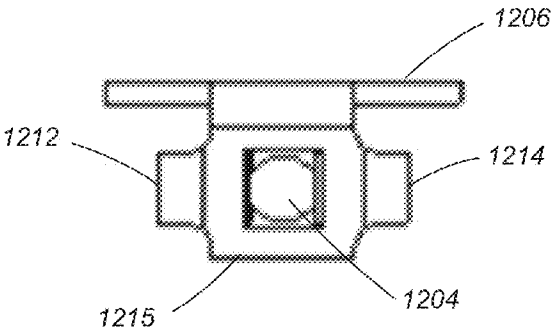
FIG. 12D is a bottom view of the illustrative contacts in the example of FIG. 12A, in accordance with some embodiments.
Figure 12C:
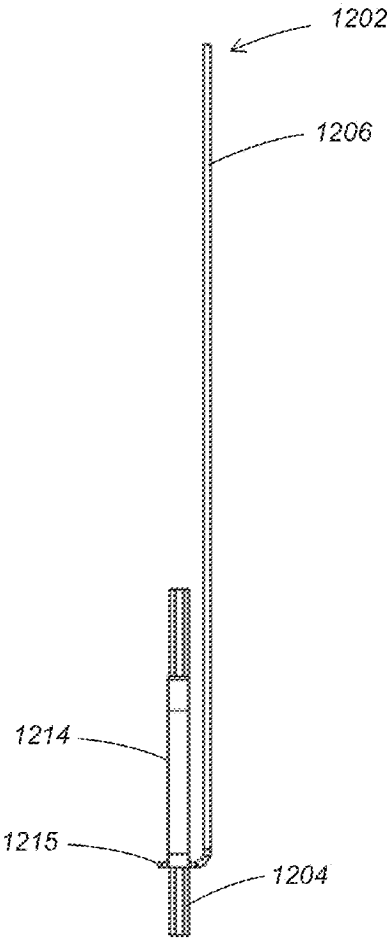
FIG. 12C is a side view of the illustrative contacts in the example of FIG. 12A, in accordance with some embodiments.

FIG. 12C is a side view of the illustrative contacts in the example of FIG. 12A, in accordance with some embodiments.

FIG. 12D is a bottom view of the illustrative contacts in the example of FIG. 12A, in accordance with some embodiments.

Figure 13B:
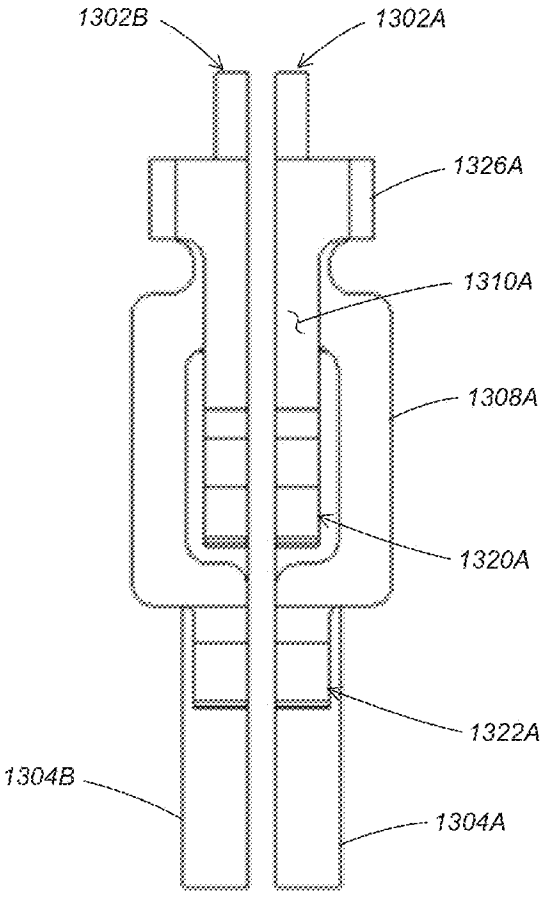
FIG. 13B is a front view of the illustrative contacts in the example of FIG. 13A, in accordance with some embodiments.
Figure 13A:
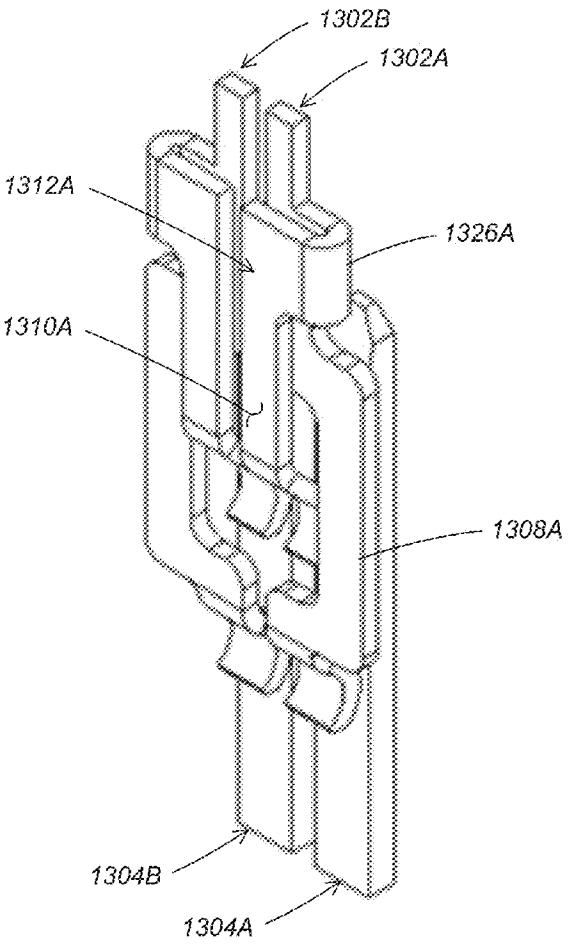
FIG. 13A shows a pair of illustrative contacts mated respectively with another pair of illustrative contacts, in accordance with some embodiments.

FIG. 13A shows a pair of illustrative contacts 1302A and 1302B mated respectively with another pair of illustrative contacts 1304A and 1304B, in accordance with some embodiments. In this example, the contact 1302A includes two elongated members 1308A and 1310A configured as beams, which may be relatively compliant, and the contact 1304A is configured as a blade, which may be relatively rigid.

Figure 13D:
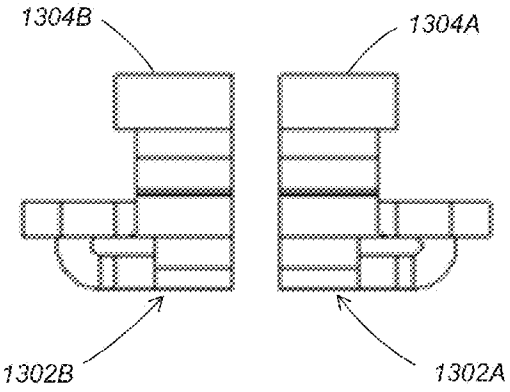
FIG. 13D is a bottom view of the illustrative contacts in the example of FIG. 13A, in accordance with some embodiments.
Figure 13C:
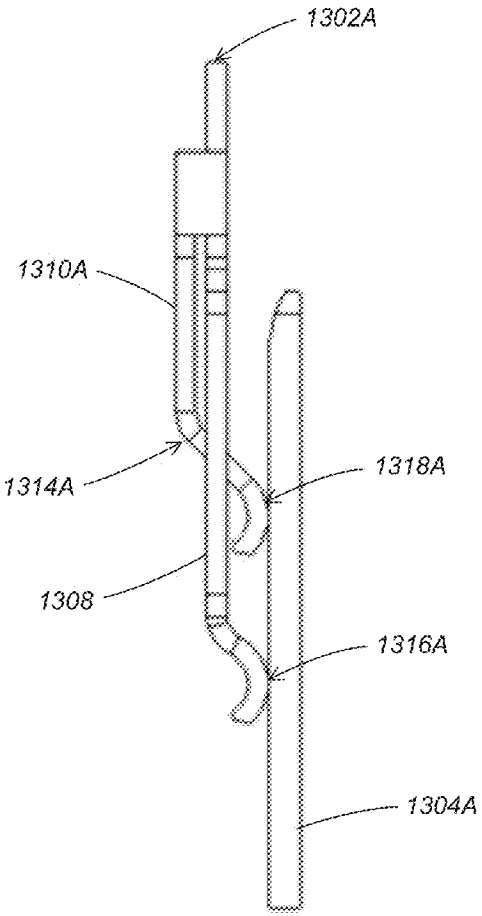
FIG. 13C is a side view of the illustrative contacts in the example of FIG. 13A, in accordance with some embodiments.

In some embodiments, the elongated members 1308A and 1310A may be configured to engage the contact 1304A in a mated configuration (e.g., as shown in FIG. 13A) to provide two points of contact 1316A and 1318A (e.g., as shown in FIG. 13C). The contact points 1316A and 1318A may be offset from each other along the length of the contact 1304A. In some embodiments, an intended contact region on the contact 1304A for the elongated member 1310A may be close to the distal end of the contact 1304A to reduce an unterminated stub length.

In some embodiments, the elongated members 1308A and 1310A may be formed by stamping two elongated portions from a single sheet of material and thereafter "folding" them over each other. For instance, in the example shown in FIG. 13A, the "fold" may be at a region 1326A connecting the elongated members 1308A and 1310A. Thus, the elongated members 1308A and 1310A may overlap or cross each other at one or more locations, for example, at a region 1312A shown in FIG. 13A and a region 1314A shown in FIG. 13C. This may allow the elongated members 1308A and 1310A to make electrical connections with the contact 1304A at two points that are vertically aligned with each other (e.g., at 1320A and 1322A in the example of FIG. 13B). However, it should be appreciated that an folding operation is not required, as the elongated members 1308A and 1310A may alternatively be separate pieces that are attached to each other, for example, by welding.

FIG. 13B is a front view of the illustrative contacts in the example of FIG. 13A, in accordance with some embodiments;

FIG. 13C is a side view of the illustrative contacts in the example of FIG. 13A, in accordance with some embodiments.

FIG. 13D is a bottom view of the illustrative contacts in the example of FIG. 13A, in accordance with some embodiments.

Figure 14B:
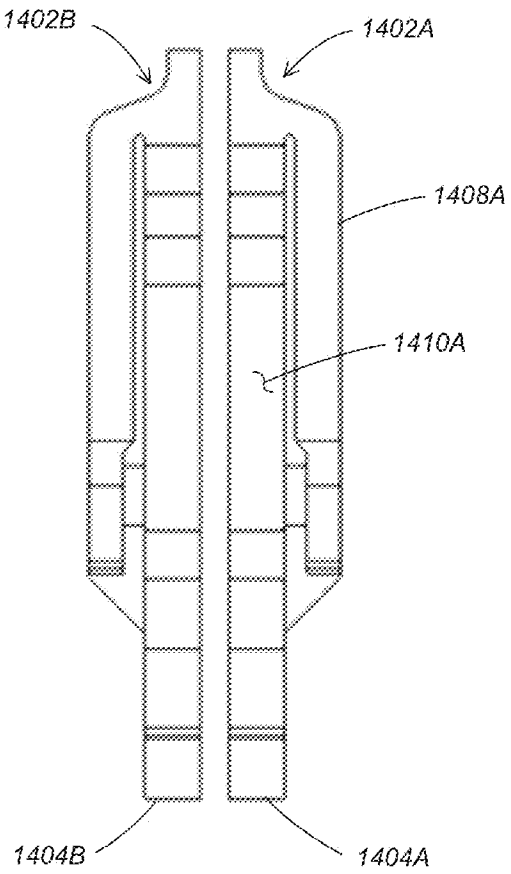
FIG. 14B is a front view of the illustrative contacts in the example of FIG. 14A, in accordance with some embodiments.
Figure 14A:
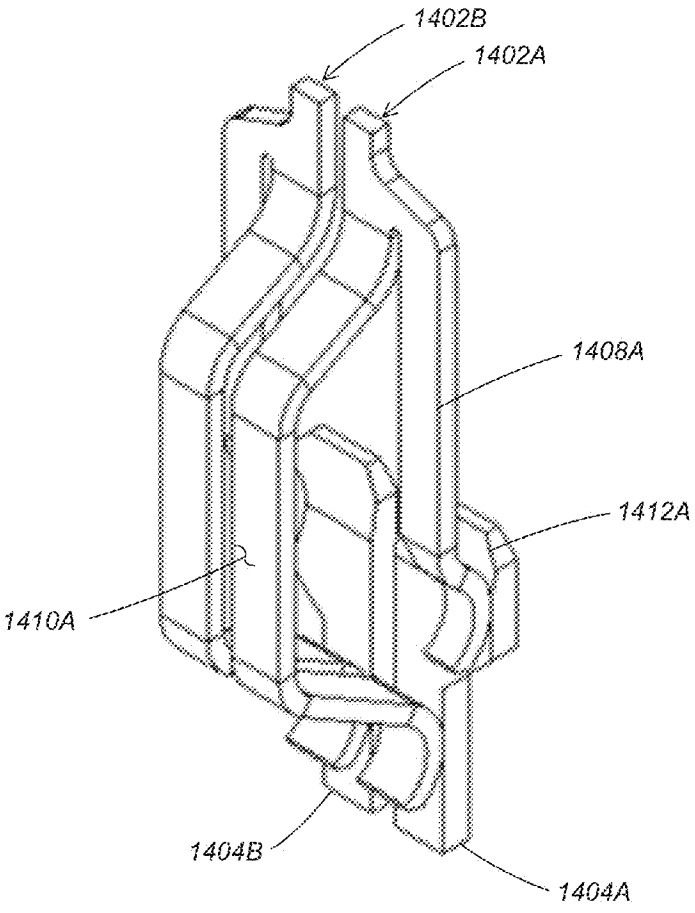
FIG. 14A shows a pair of illustrative contacts mated respectively with another pair of illustrative contacts, in accordance with some embodiments.

FIG. 14A shows a pair of illustrative contacts 1402A and 1402B mated respectively with another pair of illustrative contacts 1404A and 1404B, in accordance with some embodiments. In this example, the contact 1402A includes two elongated members 1408A and 1410A configured as beams, which may be similar to the elongated members 1308A and 1310A in the example of FIG. 13A. However, in the example of FIG. 14A, the elongated members 1408A and 1410A do not cross or overlap each other.

Figure 14D:
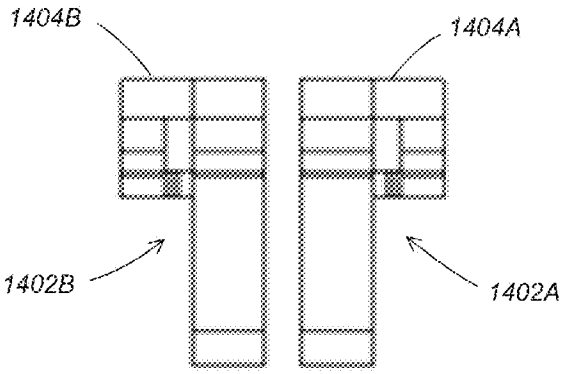
FIG. 14D is a bottom view of the illustrative contacts in the example of FIG. 14A, in accordance with some embodiments.
Figure 14C:
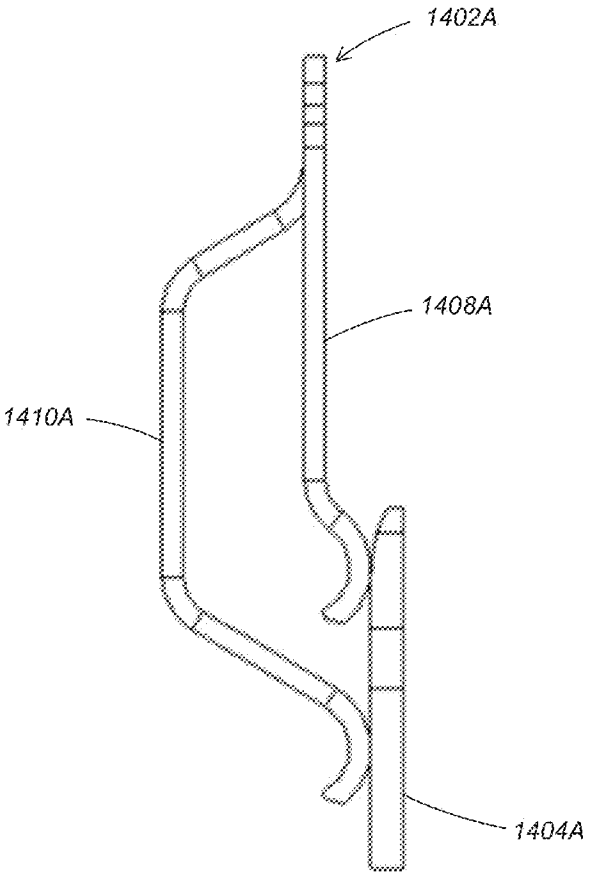
FIG. 14C is a side view of the illustrative contacts in the example of FIG. 14A, in accordance with some embodiments.

In some embodiments, the elongated members 1408A and 1410A may be configured to engage the contact 1404A in a mated configuration (e.g., as shown in FIG. 14A) to provide two points of contact 1416A and 1418A (e.g., as shown in FIG. 14C). The contact points 1416A and 1418A may be offset from each other along the length of the contact 1404A. In some embodiments, the two points of contact may be offset from each other both vertically and horizontally. For instance, in the example of FIG. 14A, the contact 1404A includes a widened planar portion 1412A at its distal end to engage the elongated member 1408A.

In the example of FIG. 14A, the elongated member 1410A is longer than the elongated member 1408A and is disposed further away from the contact 1404A. This may allow more air around the elongated members 1408A and 1410A and the contact 1404A, which may reduce impedance and thereby improve signal quality.

FIG. 14B is a front view of the illustrative contacts in the example of FIG. 14A, in accordance with some embodiments.

FIG. 14C is a side view of the illustrative contacts in the example of FIG. 14A, in accordance with some embodiments.

FIG. 14D is a bottom view of the illustrative contacts in the example of FIG. 14A, in accordance with some embodiments.

Figure 15B:
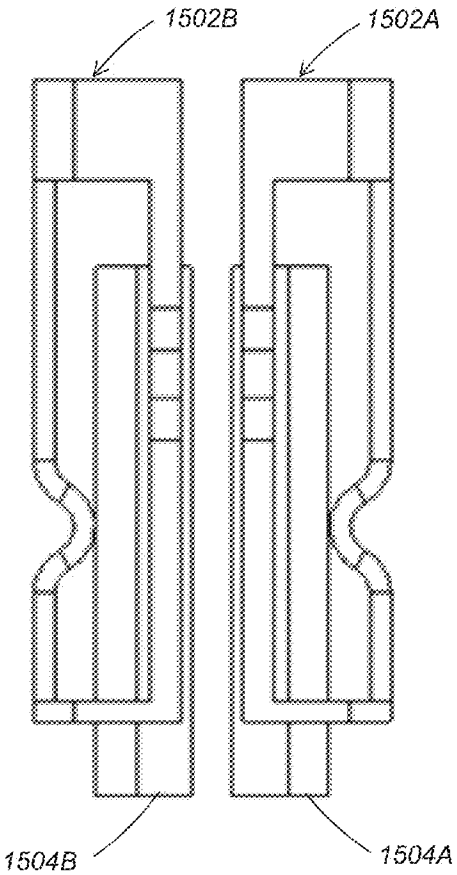
FIG. 15B is a front view of the illustrative contacts in the example of FIG. 15A, in accordance with some embodiments.
Figure 15A:
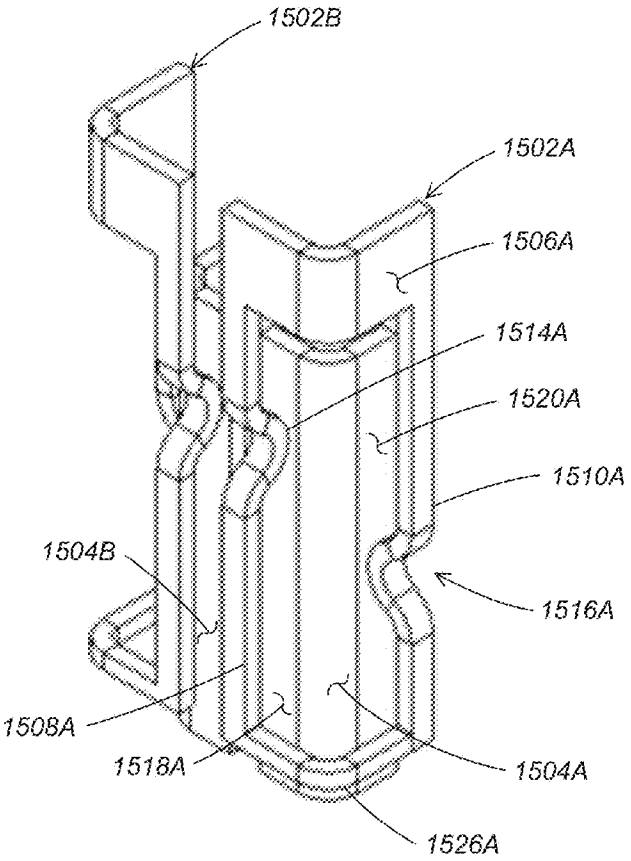
FIG. 15A shows a pair of illustrative contacts mated respectively with another pair of illustrative contacts, in accordance with some embodiments.

FIG. 15A shows a pair of illustrative contacts 1502A and 1502B mated respectively with another pair of illustrative contacts 1504A and 1504B, in accordance with some embodiments. In the example of FIG. 15A, the contact 1502A includes a base region 1506A and two elongated members 1508A and 1510A extending from the base region 1506A. In some embodiments, the elongated members 1508A and 1510A may be configured as beams each having at least one arced segment at any suitable location (e.g., the arced segments 1514A and 1516A in the example of FIG. 15A).

In the example shown in FIG. 15A, the contact 1502A further includes a strap 1526A connecting the distal ends of the elongated members 1508A and 1510A, so that the base region 1506A, the elongated members 1508A and 1510A, and the strap 1526A together form a closed lope, thereby eliminating any unterminated stub.

In some embodiments, the contact 1504A may be configured as a blade having an "L" shaped cross section and two orthogonal faces 1518A and 1520A. The base region 1506A and the strap 1526A of the contact 1502A may each include a bend to conform to the "L" shape of the contact 1504A, so that the elongated members 1508A and 1510A are disposed adjacent to the faces 1518A and 1520A, respectively. As a result, the arced segments 1514A and 1516A engage the contact 1504A at the faces 1518A and 1520A, respectively, when the contact 1502A is mated with the contact 1504A.

FIG. 15B is a front view of the illustrative contacts in the example of FIG. 15A, in accordance with some embodiments.

Figure 15C:
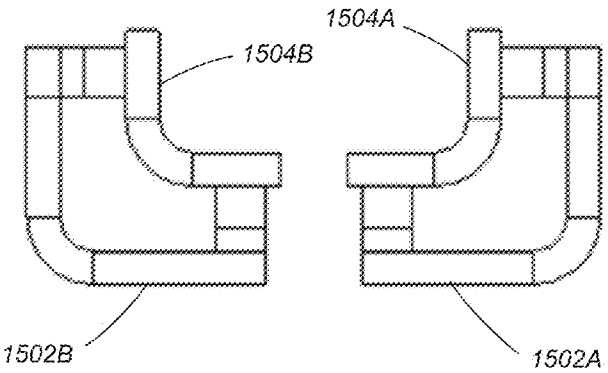
FIG. 15C is a bottom view of the illustrative contacts in the example of FIG. 15A, in accordance with some embodiments.

FIG. 15C is a bottom view of the illustrative contacts in the example of FIG. 15A, in accordance with some embodiments.

Figure 16A:
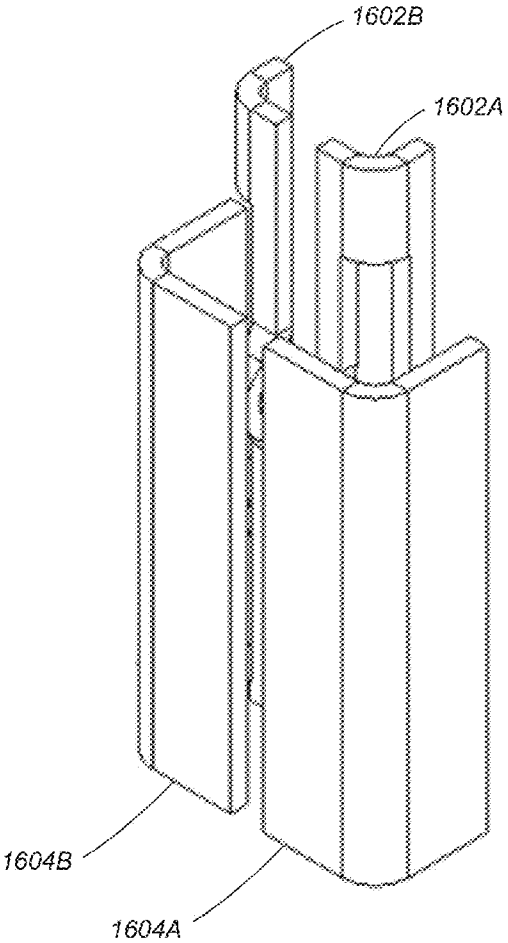
FIG. 16A shows a pair of illustrative contacts mated respectively with another pair of illustrative contacts, in accordance with some embodiments.

FIG. 16A shows a pair of illustrative contacts 1602A and 1602B mated respectively with another pair of illustrative contacts 1604A and 1604B, in accordance with some embodiments. The contacts 1602A-B and 1604A-B may be similar to the contacts 1502A-B and 1504A-B in the example of FIG. 15A. For example, like the contacts 1502A-B, the contacts 1602A-B may each have a closed-lope structure. Also, like the contacts 1504A-B, the contacts 1604A-B may each have an "L" shaped cross section. However, unlike the contacts 1502A-B, the contacts 1602A-B may be disposed inside the "L" shape of the contacts 1604A-B, rather than being on the outside. Thus, the contacts 1602A-B may make electrical connections with the contacts 1604A-B at their inner surfaces. Furthermore, the contacts 1602A-B may be partially enclosed by the contacts 1604A-B.

Figure 16C:
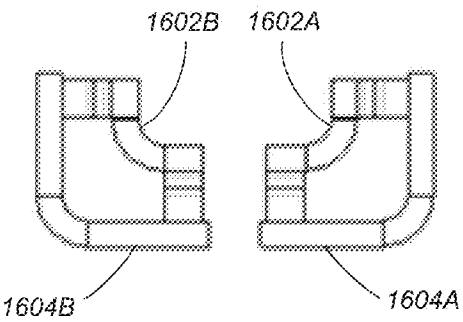
FIG. 16C is a bottom view of the illustrative contacts in the example of FIG. 16A, in accordance with some embodiments.
Figure 16B:
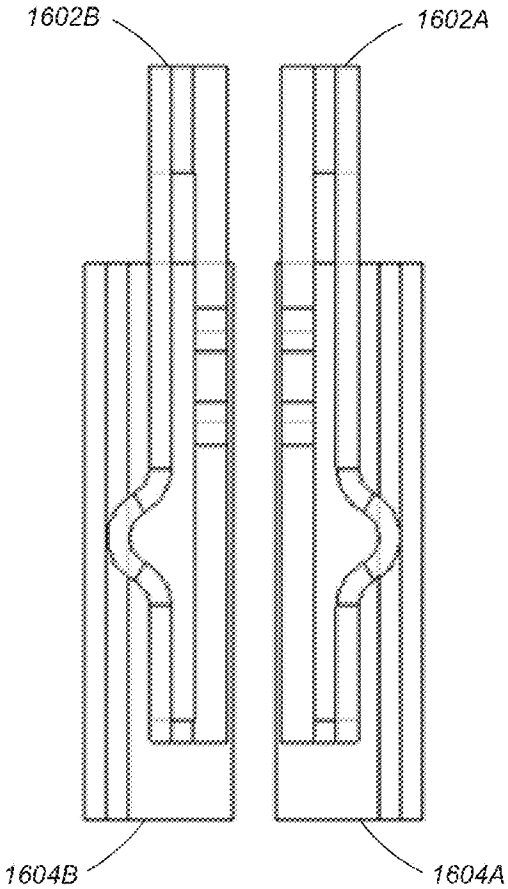
FIG. 16B is a back view of the illustrative contacts in the example of FIG. 16A, in accordance with some embodiments.

FIG. 16B is a back view of the illustrative contacts in the example of FIG. 16A, in accordance with some embodiments.

FIG. 16C is a bottom view of the illustrative contacts in the example of FIG. 16A, in accordance with some embodiments.

Figure 17B:
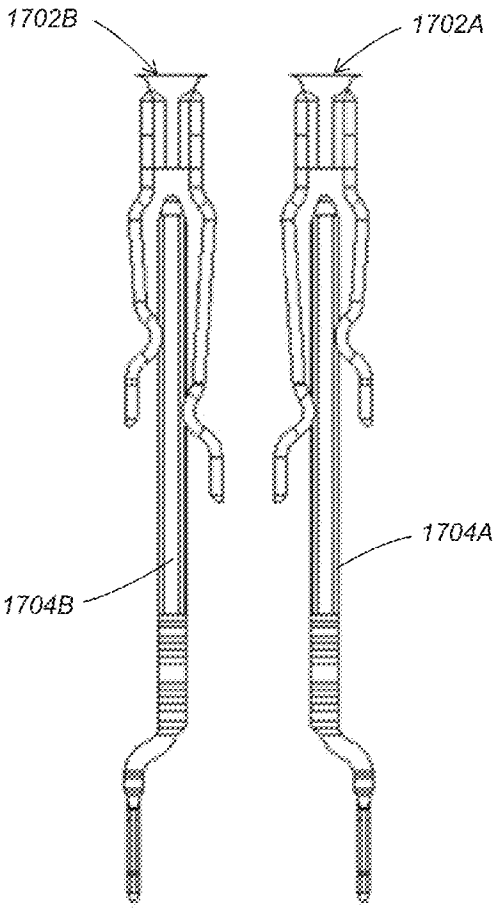
FIG. 17B is a front view of the illustrative contacts in the example of FIG. 17A, in accordance with some embodiments.
Figure 17A:
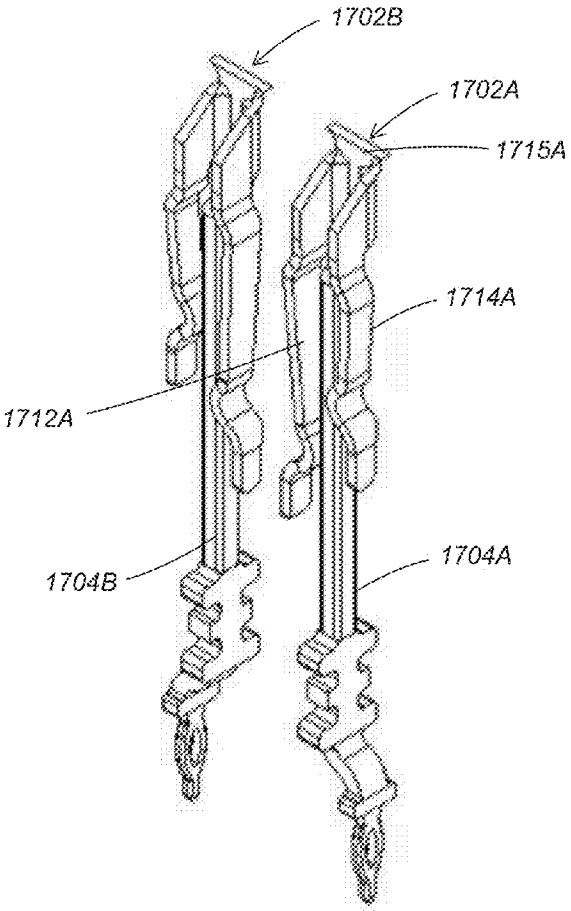
FIG. 17A shows a pair of illustrative contacts mated respectively with another pair of illustrative contacts, in accordance with some embodiments.

FIG. 17A shows a pair of illustrative contacts 1702A and 1702B mated respectively with another pair of illustrative contacts 1704A and 1704B, in accordance with some embodiments. In this example, the contact 1702A includes a base region 1715A having attached thereto two beams 1712A and 1714A, which may be configured to engage the contact 1704A. In some embodiments, the beams 1712A and 1714A may be disposed opposite to each other, so that they engage the contact 1704A at opposite sides when the contact 1704A is mated with the contact 1702A. However, it should be appreciated that aspects of the present disclosure are not limited to any particular configuration of the beams 1712A and 1714A.

FIG. 17B is a front view of the illustrative contacts in the example of FIG. 17A, in accordance with some embodiments.

Figure 18B:
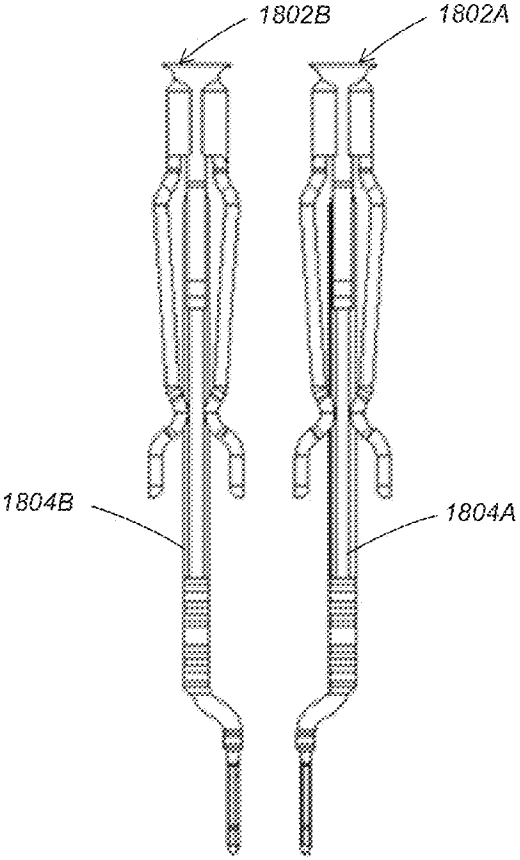
FIG. 18B is a front view of the illustrative contacts in the example of FIG. 18A, in accordance with some embodiments.
Figure 18A:
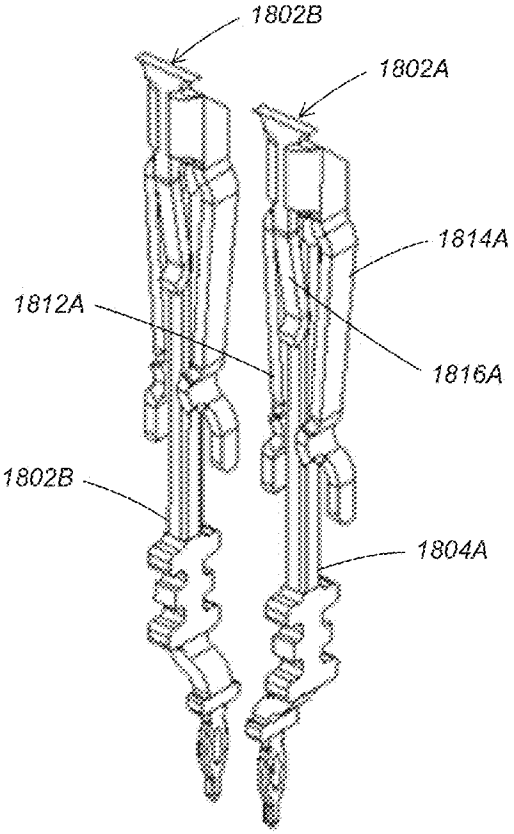
FIG. 18A shows a pair of illustrative contacts mated respectively with another pair of illustrative contacts, in accordance with some embodiments.

FIG. 18A shows a pair of illustrative contacts 1802A and 1802B mated respectively with another pair of illustrative contacts 1804A and 1804B, in accordance with some embodiments. In this example, the contact 1802A includes two opposing beams 1812A and 1814A, which may be similar to the beams 1712A and 1714A in the example of FIG. 17A. However, the contact 1802A may include an additional beam 1816A which may be shorter than the beams 1812A and 1814A. Thus, when the contact 1802A is mated with the contact 1804A, the beam 1816A makes an electrical connection with the contact 1804A at a contact region that is closer to the distal end of the contact 1804A than the contact regions for the beams 1812A and 1814A. This may reduce an unterminated stub length of the contact 1804A. Additionally, any remaining unterminated stub of the contact 1804A may be enclosed on three sides by the beams 1812A, 1814A, and 1816A, which may reduce unwanted resonances.

FIG. 18B is a front view of the illustrative contacts in the example of FIG. 18A, in accordance with some embodiments.

Figure 18D:
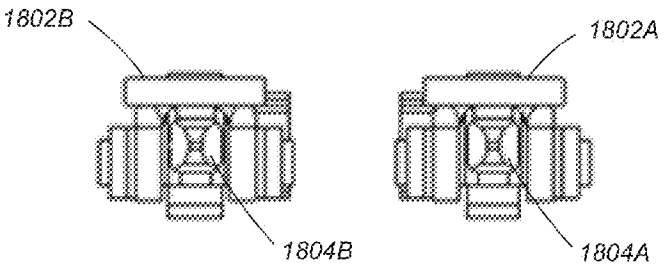
FIG. 18D is a bottom view of the illustrative contacts in the example of FIG. 18A, in accordance with some embodiments.
Figure 18C:
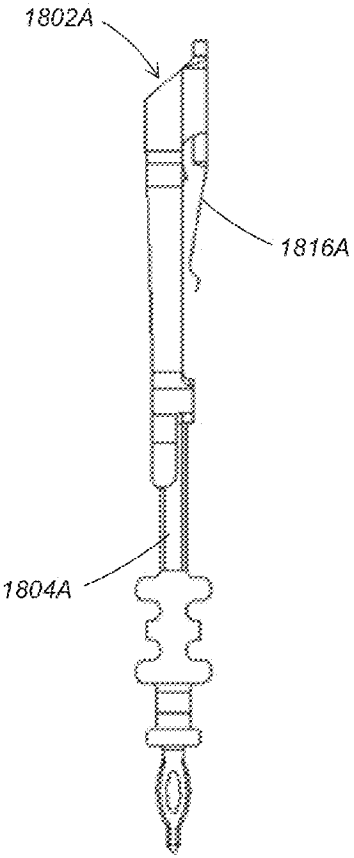
FIG. 18C is a side view of the illustrative contacts in the example of FIG. 18A, in accordance with some embodiments.

FIG. 18C is a side view of the illustrative contacts in the example of FIG. 18A, in accordance with some embodiments.

FIG. 18D is a bottom view of the illustrative contacts in the example of FIG. 18A, in accordance with some embodiments.

Figure 19B:
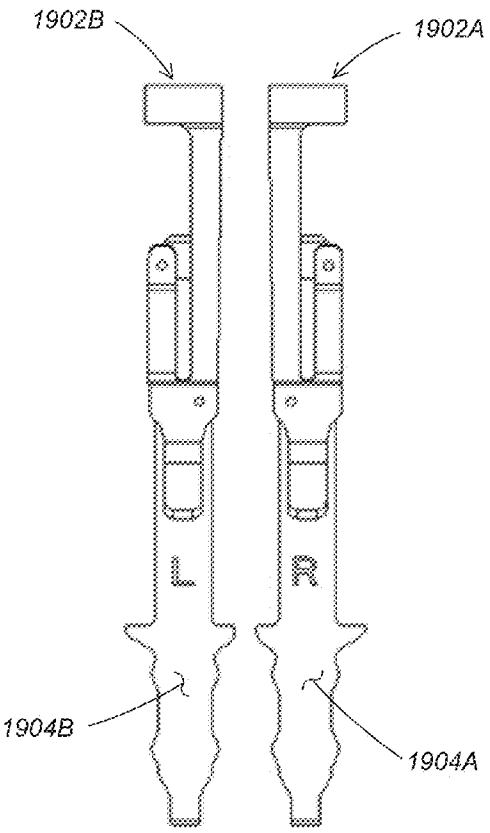
FIG. 19B is a front view of the illustrative contacts in the example of FIG. 19A, in accordance with some embodiments.
Figure 19A:
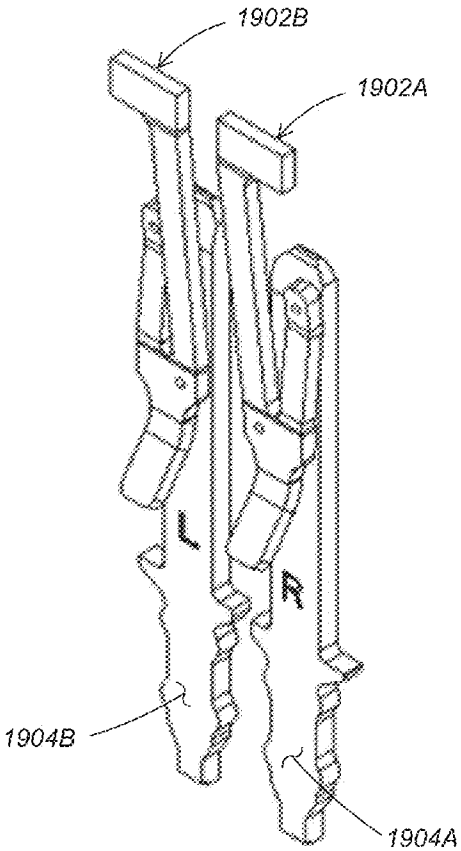
FIG. 19A shows a pair of illustrative contacts mated respectively with another pair of illustrative contacts, in accordance with some embodiments.

FIG. 19A shows a pair of illustrative contacts 1902A and 1902B mated respectively with another pair of illustrative contacts 1904A and 1904B, in accordance with some embodiments. In this example, the contact 1902A has a "Y" shaped structure.

FIG. 19B is a front view of the illustrative contacts in the example of FIG. 19A, in accordance with some embodiments.

Figure 19C:
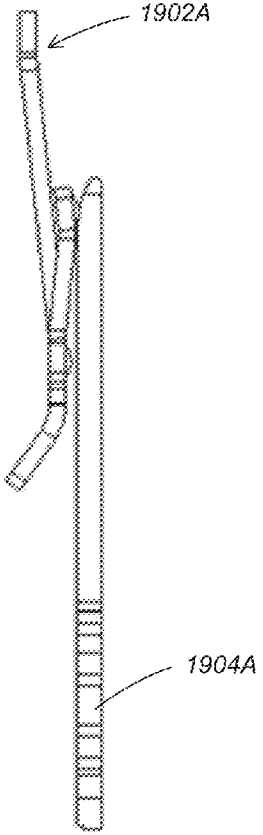
FIG. 19C is a side view of the illustrative contacts in the example of FIG. 19A, in accordance with some embodiments.

FIG. 19C is a side view of the illustrative contacts in the example of FIG. 19A, in accordance with some embodiments.

Figure 20A:
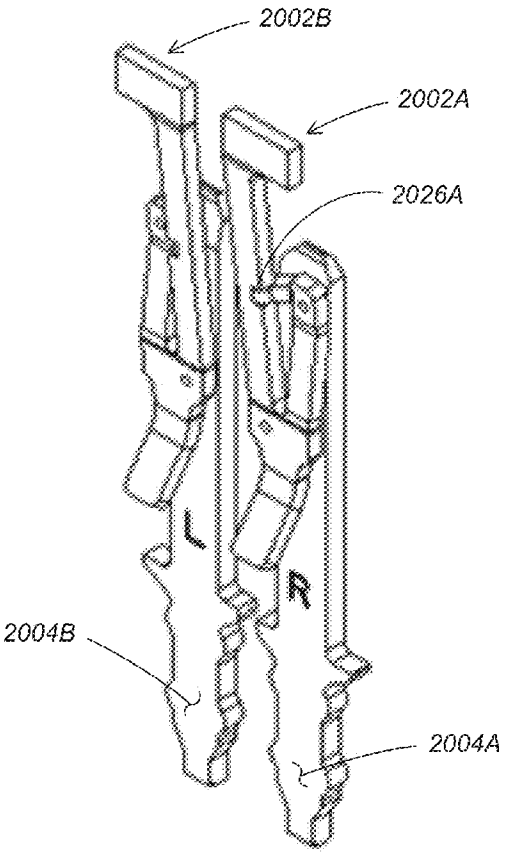
FIG. 20A shows a pair of illustrative contacts mated respectively with another pair of illustrative contacts, in accordance with some embodiments.

FIG. 20A shows a pair of illustrative contacts 2002A and 2002B mated respectively with another pair of illustrative contacts 2004A and 2004B, in accordance with some embodiments. In this example, the contact 2002A has a "Y" shaped structure with a strap 2026A connecting the two upper legs of the "Y."

Figure 20C:
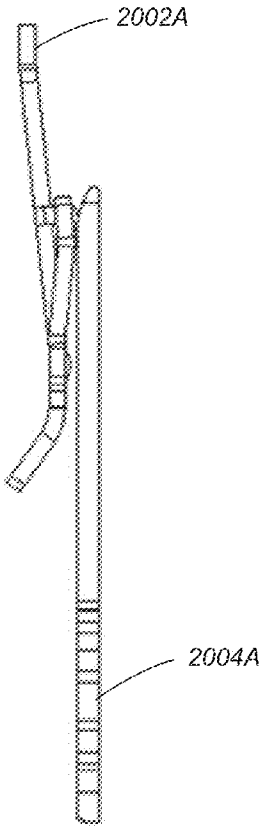
FIG. 20C is a side view of the illustrative contacts in the example of FIG. 20A, in accordance with some embodiments.
Figure 20B:
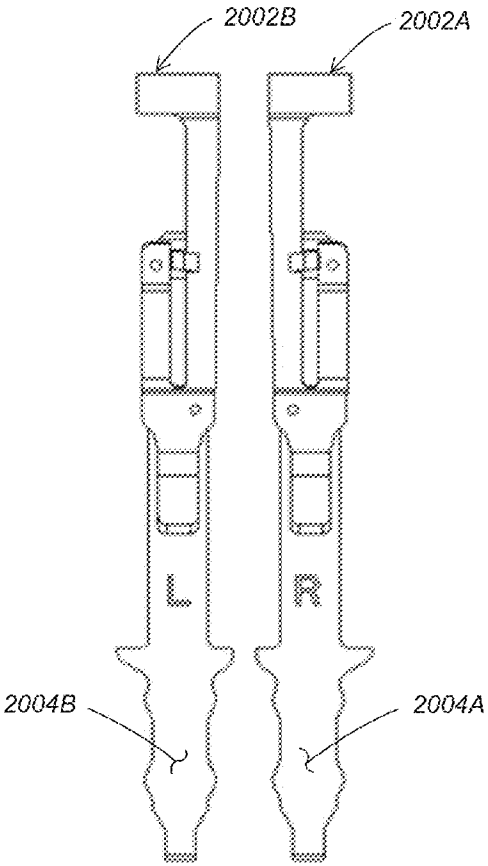
FIG. 20B is a front view of the illustrative contacts in the example of FIG. 20A, in accordance with some embodiments.
Figure 21B:
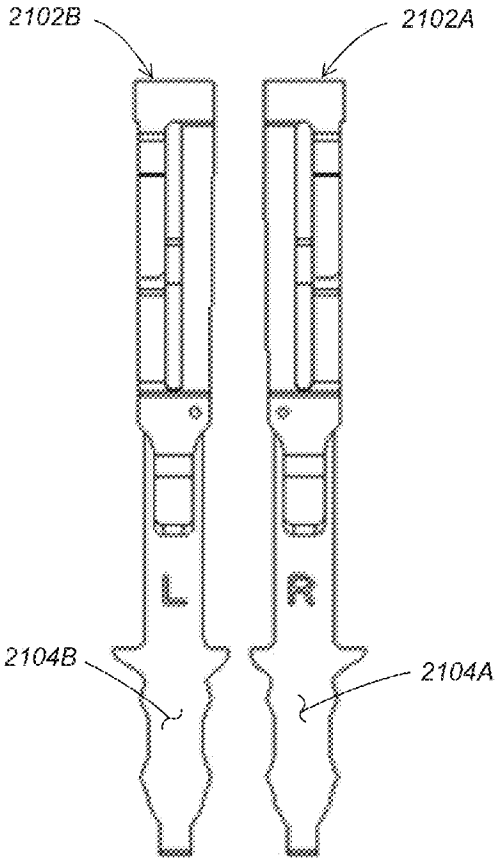
FIG. 21B is a front view of the illustrative contacts in the example of FIG. 21A, in accordance with some embodiments.
Figure 21A:
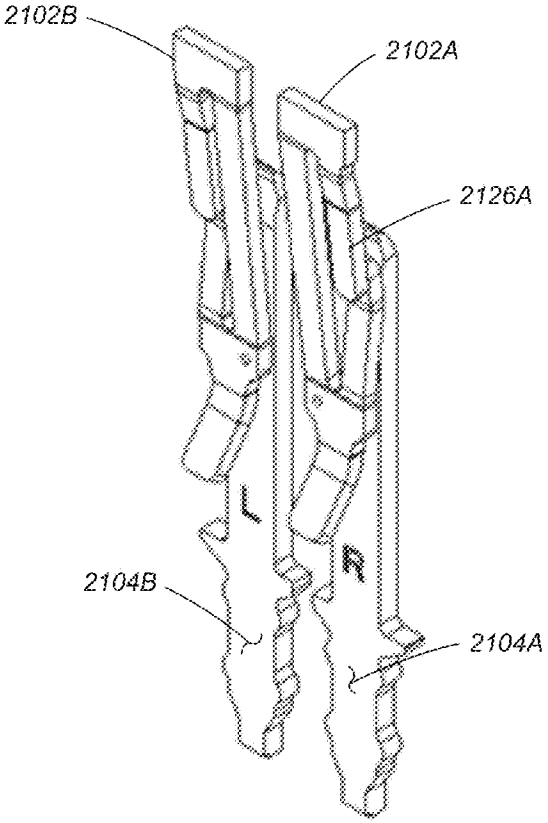
FIG. 21A shows a pair of illustrative contacts mated respectively with another pair of illustrative contacts, in accordance with some embodiments.

FIG. 20B is a front view of the illustrative contacts in the example of FIG. 20A, in accordance with some embodiments;

FIG. 20C is a side view of the illustrative contacts in the example of FIG. 20A, in accordance with some embodiments;

FIG. 21A shows a pair of illustrative contacts 2102A and 2102B mated respectively with another pair of illustrative contacts 2104A and 2104B, in accordance with some embodiments. In this example, the contact 2102A has a "Y" shaped structure with an additional leg 2126A connecting the two upper legs of the "Y."

FIG. 21B is a front view of the illustrative contacts in the example of FIG. 21A, in accordance with some embodiments.

Figure 21C:
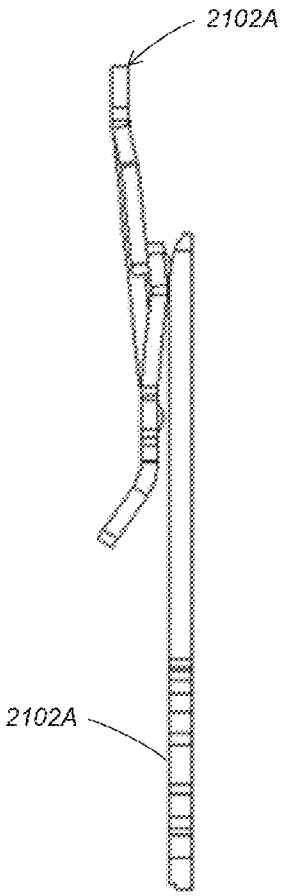
FIG. 21C is a side view of the illustrative contacts in the example of FIG. 21A, in accordance with some embodiments.

FIG. 21C is a side view of the illustrative contacts in the example of FIG. 21A, in accordance with some embodiments.

As discussed above, lossy material may be placed at one or more locations in a connector in some embodiments, for example, to reduce crosstalk. Any suitable lossy material may be used. Materials that conduct, but with some loss, over the frequency range of interest are referred to herein generally as "lossy" materials. Electrically lossy materials can be formed from lossy dielectric and/or lossy conductive materials. The frequency range of interest depends on the operating parameters of the system in which such a connector is used, but will generally have an upper limit between about 1 GHz and 25 GHz, although higher frequencies or lower frequencies may be of interest in some applications. Some connector designs may have frequency ranges of interest that span only a portion of this range, such as 1 to 10 GHz or 3 to 15 GHz or 3 to 6 GHz.

Electrically lossy material can be formed from material traditionally regarded as dielectric materials, such as those that have an electric loss tangent greater than approximately 0.003 in the frequency range of interest. The "electric loss tangent" is the ratio of the imaginary part to the real part of the complex electrical permittivity of the material. Electrically lossy materials can also be formed from materials that are generally thought of as conductors, but are either relatively poor conductors over the frequency range of interest, contain particles or regions that are sufficiently dispersed that they do not provide high conductivity or otherwise are prepared with properties that lead to a relatively weak bulk conductivity over the frequency range of interest. Electrically lossy materials typically have a conductivity of about 1 siemens/meter to about $6.1\times10^7$ siemens/meter, preferably about 1 siemens/meter to about $1\times10^7$ siemens/meter and most preferably about 1 siemens/meter to about 30,000 siemens/meter. In some embodiments material with a bulk conductivity of between about 10 siemens/meter and about 100 siemens/meter may be used. As a specific example, material with a conductivity of about 50 siemens/meter may be used. However, it should be appreciated that the conductivity of the material may be selected empirically or through electrical simulation using known simulation tools to determine a suitable conductivity that provides both a suitably low crosstalk with a suitably low insertion loss.

Electrically lossy materials may be partially conductive materials, such as those that have a surface resistivity between 1 Ω/square and 106 Ω/square. In some embodiments, the electrically lossy material has a surface resistivity between 1 Ω/square and 103 Ω/square. In some embodiments, the electrically lossy material has a surface resistivity between 10 Ω/square and 100 Ω/square. As a specific example, the material may have a surface resistivity of between about 20 Ω/square and 40 Ω/square.

In some embodiments, electrically lossy material is formed by adding to a binder a filler that contains conductive particles. In such an embodiment, a lossy member may be formed by molding or otherwise shaping the binder into a desired form. Examples of conductive particles that may be used as a filler to form an electrically lossy material include carbon or graphite formed as fibers, flakes or other particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. The binder or matrix may be any material that will set, cure or can otherwise be used to position the filler material. In some embodiments, the binder may be a thermoplastic material such as is traditionally used in the manufacture of electrical connectors to facilitate the molding of the electrically lossy material into the desired shapes and locations as part of the manufacture of the electrical connector. Examples of such materials include LCP and nylon. However, many alternative forms of binder materials may be used. Curable materials, such as epoxies, may serve as a binder. Alternatively, materials such as thermosetting resins or adhesives may be used.

Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic component or a metal component. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Ticona. A lossy material, such as lossy conductive carbon filled adhesive preform, such as those sold by Techfilm of Billerica, Mass., US may also be used. This preform can include an epoxy binder filled with carbon particles. The binder surrounds carbon particles, which acts as a reinforcement for the preform. Such a preform may be inserted in a wafer to form all or part of the housing. In some embodiments, the preform may adhere through the adhesive in the preform, which may be cured in a heat treating process. In some embodiments, the adhesive in the preform alternatively or additionally may be used to secure one or more conductive elements, such as foil strips, to the lossy material.

Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

In some embodiments, a lossy member may be manufactured by stamping a preform or sheet of lossy material. For example, an insert may be formed by stamping a preform as described above with an appropriate patterns of openings. However, other materials may be used instead of or in addition to such a preform. A sheet of ferromagnetic material, for example, may be used.

However, lossy members also may be formed in other ways. In some embodiments, a lossy member may be formed by interleaving layers of lossy and conductive material, such as metal foil. These layers may be rigidly attached to one another, such as through the use of epoxy or other adhesive, or may be held together in any other suitable way. The layers may be of the desired shape before being secured to one another or may be stamped or otherwise shaped after they are held together.

Having thus described several embodiments, it is to be appreciated various alterations, modifications, and improvements may readily occur to those skilled in the art. Such alterations, modifications, and improvements are intended to be within the spirit and scope of the invention. Accordingly, the foregoing description and drawings are by way of example only.

Various changes may be made to the illustrative structures shown and described herein. For example, examples of techniques are described for improving signal quality at the mating interface of an electrical interconnection system. These techniques may be used alone or in any suitable combination. Furthermore, the size of a connector may be increased or decreased from what is shown. Also, it is possible that materials other than those expressly mentioned may be used to construct the connector. As another example, connectors with four differential signal pairs in a column are used for illustrative purposes only. Any desired number of signal conductors may be used in a connector.

Manufacturing techniques may also be varied. For example, embodiments are described in which the daughter card connector 116 is formed by organizing a plurality of wafers onto a stiffener. It may be possible that an equivalent structure may be formed by inserting a plurality of shield pieces and signal receptacles into a molded housing.

Furthermore, although many inventive aspects are shown and described with reference to a daughter board connector having a right angle configuration, it should be appreciated that aspects of the present disclosure is not limited in this regard, as any of the inventive concepts, whether alone or in combination with one or more other inventive concepts, may be used in other types of electrical connectors, such as backplane connectors, cable connectors, stacking connectors, mezzanine connectors, I/O connectors, chip sockets, etc.

What is claimed is:

1. A contact for a high speed electrical connector, the contact comprising:

a base region;

a first elongated member comprising a proximal portion and a distal portion, the proximal portion of the first elongated member being attached to the base region;

a second elongated member comprising a proximal portion and a distal portion, the proximal portion of the second elongated member being attached to the base region; and a strap coupling the first elongated member to the second elongated member, wherein the strap is conductive and compliant such that the first elongated member is capable of moving independently of and is electrically connected to the second elongated member, and wherein:

the distal portion of the first elongated member comprises a contact region; and the compliant strap is attached to the first elongated member at a location between the contact region and the proximal portion of the first elongated member.

2. The contact of claim 1, wherein:

the contact region of the first elongated member comprises an arced segment with a contact surface on a convex region of the arced segment.

3. The contract of claim 2, wherein:

the distal portion of the second elongated member comprises a planar member.

4. The contact of claim 3, in combination with a like mating contact, wherein:

the contact surface of the first elongated member of the contact presses against the planar member of the second elongated element of the mating contact; and the contact surface of the first elongated member of the mating contact presses against the planar member of the second elongated element of the contact.

5. The contact of claim 4, wherein:

the strap of the contact is attached to the second elongated member of the contact at a location distal to a point of contact between the second elongated member of the contact and the contact surface of the first elongated member of the mating contact.

6. The contact of claim 3, wherein:

the first elongated member extends from the base region by a greater distance than the second elongated member.

7. The contact of claim 1, wherein:

the strap couples the distal portion of the first elongated member to the distal portion of the second elongated member.

8. The contact of claim 1, wherein:

the first elongated member and the second elongated member each have a length greater than a width, and the width is greater than a thickness; and the first elongated member is disposed with its width parallel to the width of the second elongated member.

9. The contact of claim 1, wherein:

the first elongated member and the second elongated member each have a length greater than a width, and the width is greater than a thickness; and the first elongated member is disposed with its width perpendicular to the width of the second elongated member.

10. The contact of claim 1, in combination with an insulative housing, wherein the contact extends from the insulative housing with the base region adjacent the housing.

11. The contact of claim 1, in combination with an insulative housing and a plurality of like contacts, wherein the contact and the plurality of like contacts extend from the insulative housing in a column.

12. An electrical connector comprising:

a plurality of conductive members, each conductive member comprising a contact tail, a contact portion, and an intermediate portion joining the contact tail to the contact portion, wherein:

the mating contact portions are arranged in a plurality of parallel columns;

for each of the plurality of conductive members, the mating contact portion comprises a blade connected to the intermediate portion and a beam connected to the intermediate portion and a conductive, compliant member linking the blade to the beam; and for each of the plurality of conductive members, the beam comprises a contact region, and the compliant member is connected to the beam at a location between the contact region and the intermediate portion.

13. The electrical connector of claim 12, wherein:

for each of the plurality of conductive members, the beam comprises an arced portion.

14. The electrical connector of claim 13, wherein:

for each of the plurality of conductive members, the contact region is coated with a ductile material.

15. The electrical connector of claim 13, wherein:

for each of the plurality of conductive members, the compliant member is connected to the blade at a location adjacent a distal portion of the blade.

16. The electrical connector of claim 12, wherein:

for each of the plurality of conductive members, the blade and beam are configured for mating with a like beam and like blade, respectively, of a mating electrical connector.

17. The electrical connector of claim 12, wherein:

for each of the plurality of conductive members, the blade is parallel to the beam.

18. The electrical connector of claim 12, wherein:

for each of the plurality of conductive members, the blade is perpendicular to the beam.

19. A contact for a high speed electrical connector, in combination with a like contact, the contact comprising:

a base region;

a first elongated member comprising a proximal portion and a distal portion, the proximal portion of the first elongated member being attached to the base region;

a second elongated member comprising a proximal portion and a distal portion, the proximal portion of the second elongated member being attached to the base region; and a strap coupling the first elongated member to the second elongated member, wherein:

the strap is conductive and compliant such that the first elongated member is capable of moving independently of and is electrically connected to the second elongated member;

the distal portion of the first elongated member comprises an arced segment with a contact surface on a convex region of the arced segment;

the distal portion of the second elongated member comprises a planar member;

the contact surface of the first elongated member of the contact presses against the planar member of the second elongated element of the mating contact; and the contact surface of the first elongated member of the mating contact presses against the planar member of the second elongated element of the contact.

20. The contact of claim 19, wherein:

the strap of the contact is attached to the second elongated member of the contact at a location distal to a point of contact between the second elongated member of the contact and the contact surface of the first elongated member of the mating contact.

* * * * *